US010173829B2

(12) United States Patent
Sawyers

(10) Patent No.: US 10,173,829 B2
(45) Date of Patent: Jan. 8, 2019

(54) FOOD CONTAINER WITH SELF-ACTUATOR

(71) Applicant: Andrew Sawyers, Hurst, TX (US)

(72) Inventor: Andrew Sawyers, Hurst, TX (US)

( * ) Notice: Subject to any disclaimer, the term of this patent is extended or adjusted under 35 U.S.C. 154(b) by 0 days.

(21) Appl. No.: 15/436,087

(22) Filed: Feb. 17, 2017

(65) Prior Publication Data

US 2017/0240340 A1 Aug. 24, 2017

Related U.S. Application Data

(60) Provisional application No. 62/297,128, filed on Feb. 18, 2016.

(51) Int. Cl.
*B65D 83/00* (2006.01)

(52) U.S. Cl.
CPC ..... *B65D 83/0005* (2013.01)

(58) Field of Classification Search
CPC .. B65D 83/0005; B65D 3/26; B65D 81/3848; B65D 5/4266; B65D 5/0254; B65D 3/28; B65D 3/06; B65D 3/04; B65D 81/38; B65D 5/008
USPC ..... 220/592.01–592.28, 8, 23.83–23.89, 220/4.01–7
See application file for complete search history.

(56) References Cited

U.S. PATENT DOCUMENTS

| | | | | | |
|---|---|---|---|---|---|
| 3,819,040 | A * | 6/1974 | Coons | A63B 39/025 | 206/315.9 |
| 4,596,340 | A * | 6/1986 | Luther | B65D 21/086 | 220/8 |
| 4,865,211 | A * | 9/1989 | Hollingsworth | B65D 1/0292 | 220/8 |
| 5,016,772 | A * | 5/1991 | Wilk | B65D 21/086 | 220/495.01 |
| 5,078,287 | A * | 1/1992 | Holmes, III | A61J 9/00 | 215/11.1 |
| 5,605,242 | A * | 2/1997 | Hwang | B65D 21/086 | 220/4.03 |
| 5,799,808 | A * | 9/1998 | Oh | A61J 9/00 | 215/11.1 |
| 6,026,685 | A * | 2/2000 | Weterrings | G01F 19/00 | 220/8 |
| 2008/0237229 | A1* | 10/2008 | Fried | B65D 21/086 | 220/8 |
| 2014/0131366 | A1* | 5/2014 | Lim | B65D 81/3216 | 220/592.17 |

* cited by examiner

*Primary Examiner* — Kareen K Thomas
(74) *Attorney, Agent, or Firm* — Sheri Higgins Law; Sheri Higgins

(57) ABSTRACT

A non-liquid food container device comprises: a container for housing the non-liquid food product; and an actuator, wherein the actuator is self-actuated to move the non-liquid food product through the container. The food product can be self-actuated through the container by applying a force to the actuator. The food product can be moved towards an opening in the container for consumption of the food product by a consumer.

15 Claims, 29 Drawing Sheets

FOOD CONTAINER WITH SELF-ACTUATOR

TECHNICAL FIELD

Fast food restaurants provide a variety of food products to customers. Containers for the food products can be self-actuated to move the food product through the container. The self-actuated container can aid the customer in consuming the food products in an easy and neat manner.

BRIEF DESCRIPTION OF THE FIGURES

The features and advantages of certain embodiments will be more readily appreciated when considered in conjunction with the accompanying figures. The figures are not to be construed as limiting any of the preferred embodiments.

DETAILED DESCRIPTION

Figure 1B:
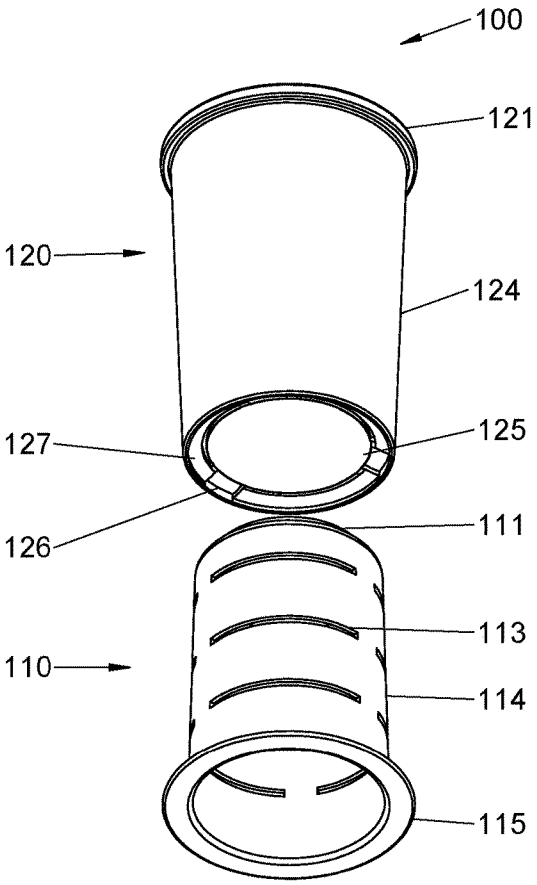
FIG. 1B is a perspective view of the food container device of FIG. 1A.

Fast food restaurants sell billions of dollars' worth of food products annually. Packaging and containers for the food products are generally designed to be easily stored without taking up more space than necessary and easy to place the food product inside the packaging or container. However, such packing or container does not provide for a neat and easy way to consume the food product—especially when trying to consume the food product while in a motor vehicle. The result is often times a frustrating and messy endeavor. As such, there is a need for an improved food container.

It has been discovered that a food container device including a container for housing a non-liquid food product and an actuator can be used for consuming the food product. The actuator can be self-actuated by a consumer to move the food product through the container. In this manner, the food product may be consumed in a simple and neat manner. As used herein, a "fluid" is a substance having a continuous phase that tends to flow and to conform to the outline of its container when the substance is tested at a temperature of 71° F. (22° C.) and a pressure of 1 atmosphere "atm" (0.1 megapascals "MPa"). A fluid can be a liquid or gas. As used herein, the term "non-liquid" means a food product that is not in liquid form.

According to certain embodiments, a non-liquid food container device comprises: a container for housing the non-liquid food product; and an actuator, wherein the actuator is self-actuated to move the non-liquid food product through the container.

Turning to the Figures, FIGS. 1A-1D depict a non-liquid food container device 100 according to certain embodiments. The food container device 100 can include a container 120 for housing a food product (not shown). The container 120 can be made in a variety of shapes, including but not limited to, cylindrical, conical, pyramidal, square, rectangular, and half-circle. In this manner, the container can house a variety of food products, including but not limited to, cylindrical-, round-, square-, rectangular-, and oval-shaped food products, among other shapes. By way of example, the container can house food products such as hamburgers, burritos, taquitos, wraps, tacos, and pizzas. The cylindrical- and conical-shaped containers depicted in FIGS. 1A-6E can be useful for housing cylindrical-, round-, and oval-shaped food products, such as burritos, taquitos, and wraps.

The container 120 can include a top end 121, a bottom end 125, and sidewalls 124. The top end 121 can include a lip. The bottom end 125 can include one or more flanges 127 created by one or more breakable tabs or voids 126. The flanges 127 can be arranged circumferentially around the bottom end 125 of the container 120. The flanges 127 can have different widths, and the sum of the widths of the flanges 127 can span most of circumference of the bottom end of the container.

The food container device 100 also includes an actuator 110. The actuator 110 can be operatively connected to the container 120. According to certain embodiments, the actuator 110 is a separate component from the container 120. As seen in FIG. 1A, the actuator 110 is operatively connected on top of the container 120. In this manner, a food product can be placed inside the container 120 and then the actuator 110 can be placed on top of the container 120 to be given to a consumer. The food product can then be transported to another location.

The actuator 110 can include a top end 111 with a rim 112, a bottom end 115, and sidewalls 114. The actuator 110 can also include one or more slots 113 located at various locations along a longitudinal axis of the actuator 110, wherein the slots 113 create voids within the sidewalls 114 of the actuator 110. At each location along the longitudinal axis, there can be one or more of the slots 113 that are arranged circumferentially around the sidewalls 114 of the actuator 110. As seen in FIGS. 1A-1D, there are 3 sets of slots 113 arranged circumferentially around the sidewalls 114 of the actuator 110 at 3 different locations. The number of slots 113 and the width of the slots 113 can be selected such that a given flange 127 can fit within a corresponding slot 113. Moreover, the breakable tabs or voids 126 can align with the solid portions of the sidewalls 114 that are located between the slots 113.

Figure 1A:
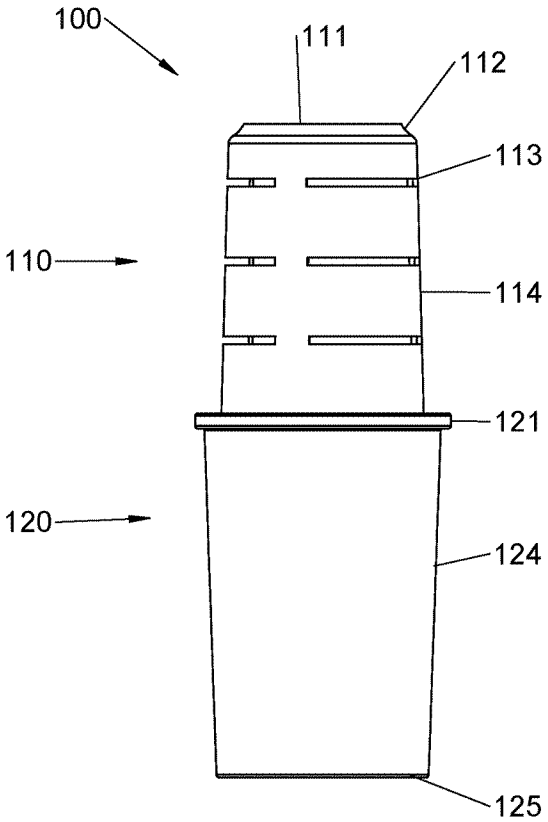
FIG. 1A is a cross-sectional view of a food container device according to certain embodiments.
Figure 1D:
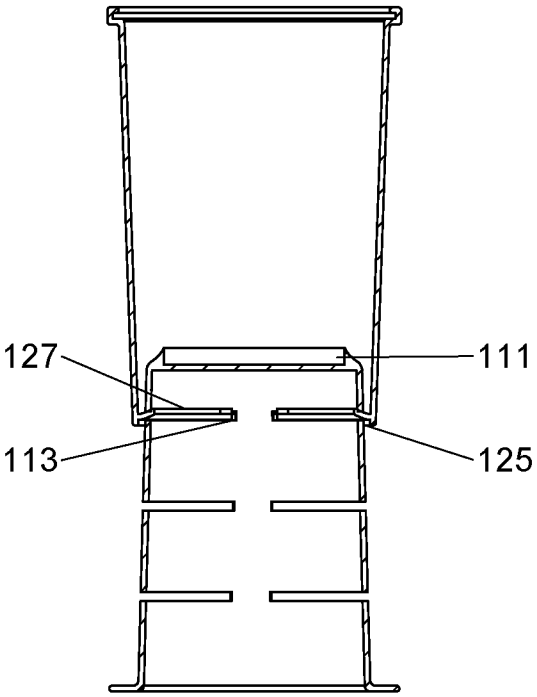
FIG. 1D is a cross-sectional view of the food container device of FIG. 1C taken along lines 1-1.
Figure 1C:
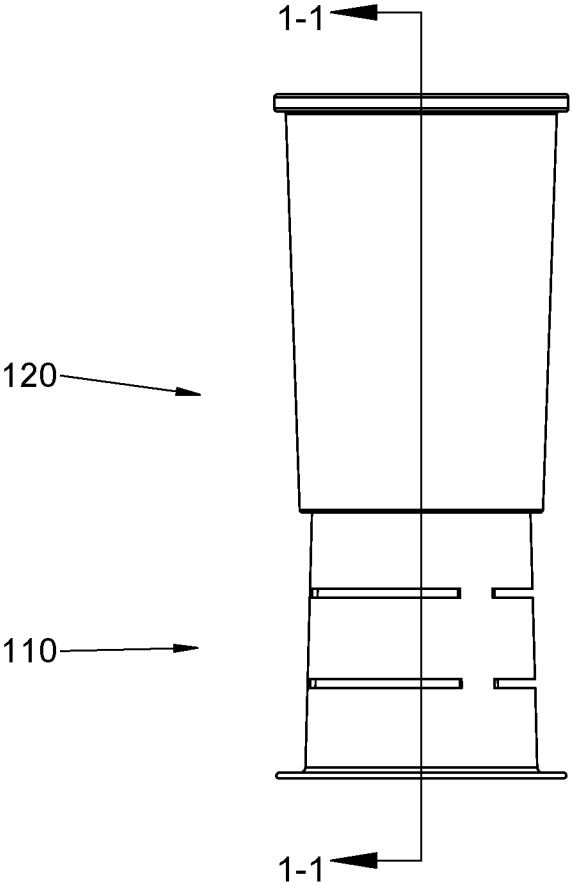
FIG. 1C is a cross-sectional view of the food container device of FIG. 1A according to certain embodiments.
Figure 2B:
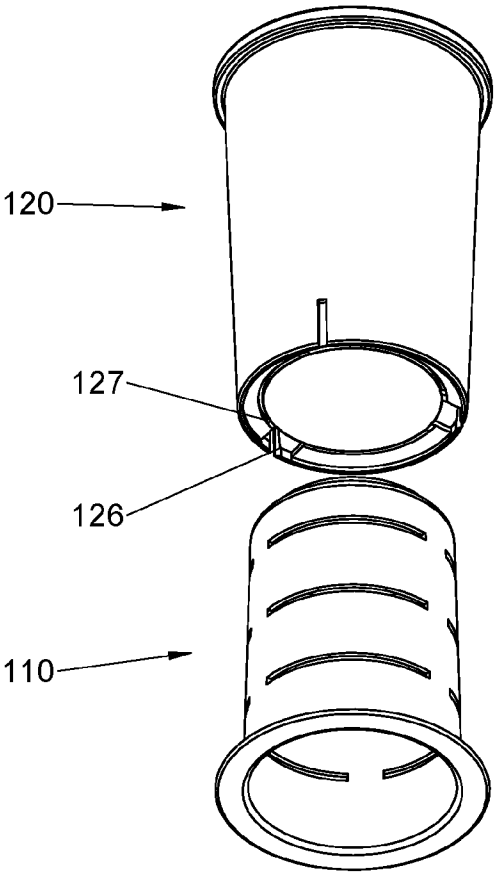
FIG. 2B is a perspective view of the food container device of FIG. 2A.
Figure 2A:
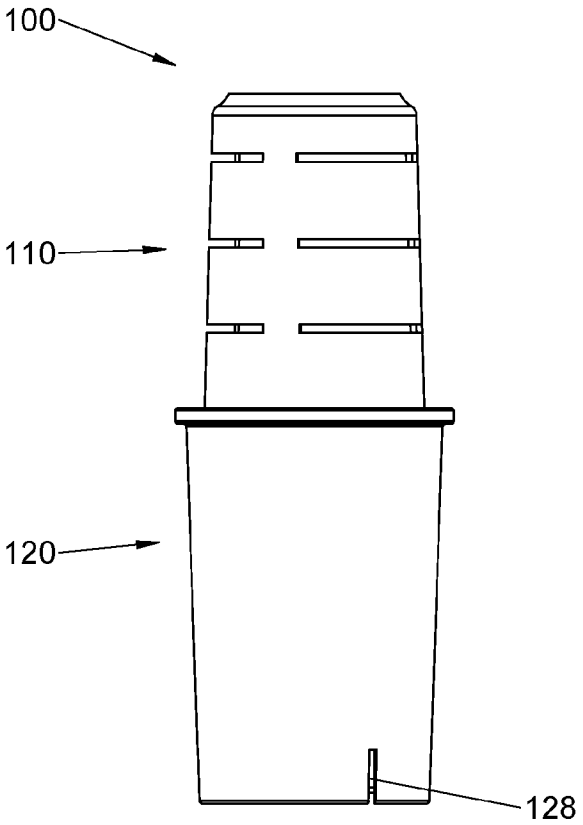
FIG. 2A is a cross-sectional view of a food container device according to certain other embodiments.
Figure 2D:
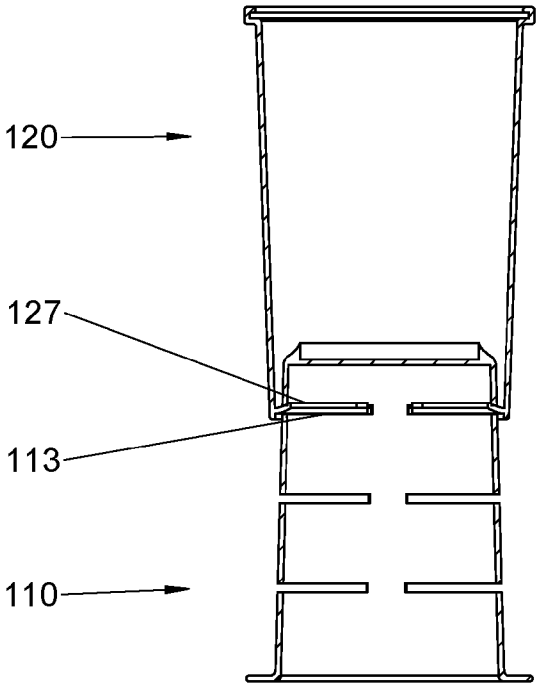
FIG. 2D is a cross-sectional view of the food container device of FIG. 2C taken along lines 2-2.
Figure 2C:
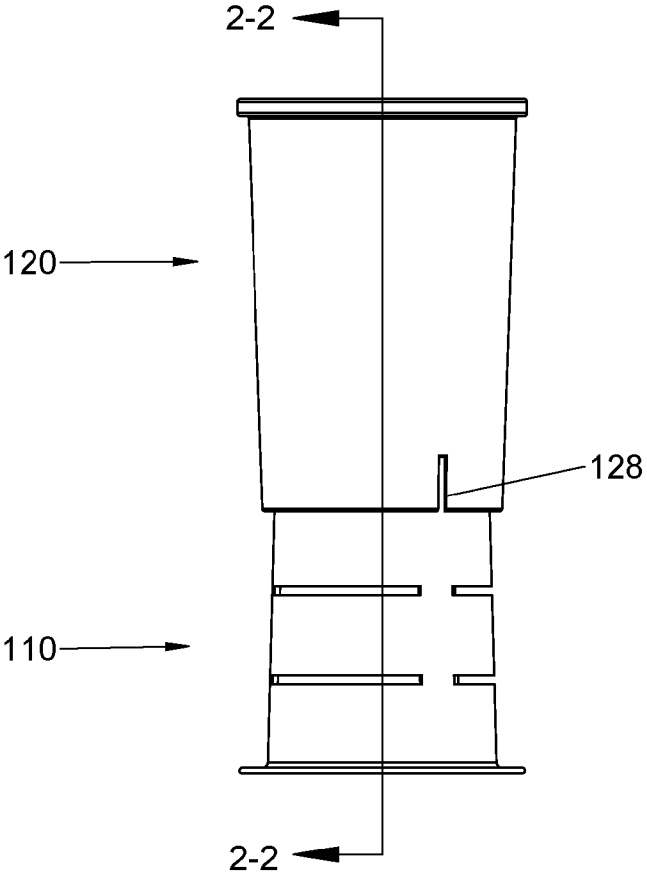
FIG. 2C is a cross-sectional view of the food container device of FIG. 2A according to certain embodiments.

Turning to FIGS. 1B-1D, when the consumer desires to consume the non-liquid food product, the consumer can remove the actuator 110 from the top of the container 120 and insert the top end 111 of the actuator 110 into the bottom end 125 of the container 120. The top end 111 of the actuator 110 can break the breakable tabs 126 (if present) or break through the bottom of the container 120; thus leaving just the flanges 127. The food product can be pushed upwards to the top end 121 of the container 120 for consumption by self-actuating the actuator 110 in an upward movement. As the actuator 110 is moved upwards through the container 120, the flanges 127 can mate with and fit within the slots 113 of the actuator 110. This mating engagement can prevent downward movement of the food product and the actuator 110.

FIGS. 2A-2D depict a food container device 100 similar to the device depicted in FIGS. 1A-1D, with the addition of one or more vertical cutouts 128 located along the sidewalls towards the bottom end 125 of the container 120. The cutouts 128 can be positioned adjacent to the breakable tabs or voids 126. The cutouts 128 can provide some flex at the bottom end 125 of the container 120 as the actuator 110 is self-actuated up through the container 120.

Figure 3B:
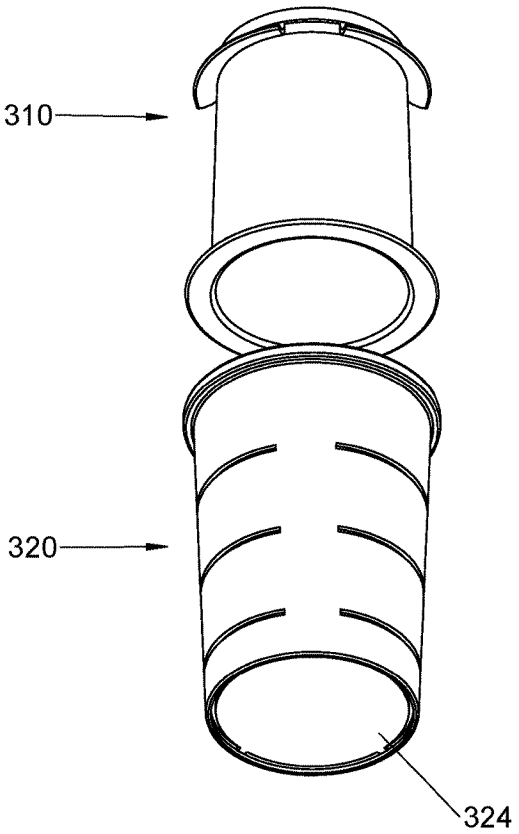
FIGS. 3A-3D are perspective and cross-sectional views of a food container device according to certain other embodiments.
Figure 3A:
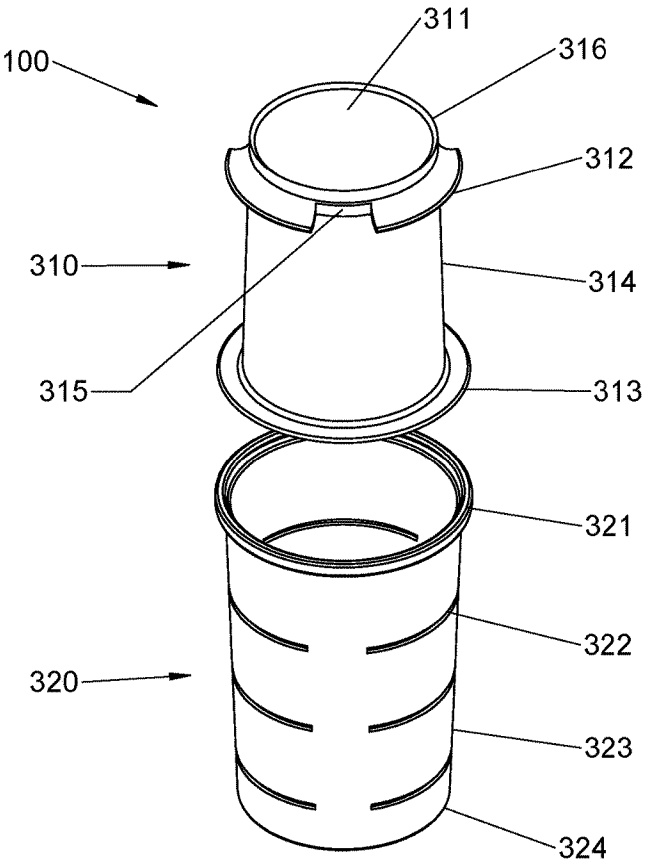

FIGS. 3A-3D depict a food container device 100 according to certain other embodiments. The container 320 can include a top end 321, a bottom end 324, and sidewalls 323. The food container device 100 also includes an actuator 310. The actuator 310 can be operatively connected to the container 320. According to certain embodiments, the actuator 310 is a separate component from the container 320. As seen in FIGS. 3A and 3B, the actuator 310 is operatively connected on top of the container 320. In this manner, a food product can be placed inside the container 320 and then the actuator 310 can be placed on top of the container 320 to be given to a consumer. The food product can then be transported to another location.

The actuator 310 can include a top end 311 with a rim 316, a bottom end 313, and sidewalls 314. The top end 311 can include one or more flanges 312 created by one or more breakable tabs or voids 315. The flanges 312 can be arranged circumferentially around the top end 311 of the actuator 310. The flanges 312 can have different widths, and the sum of the widths of the flanges 312 can span most of circumference of the top end of the actuator. The flanges 312 can also be positioned at a location at or near the middle of the actuator instead of around the top end.

The container 320 can also include one or more slots 322 located at various locations along a longitudinal axis of the container 320, wherein the slots 322 create voids within the sidewalls 323 of the container 320. At each location along the longitudinal axis, there can be one or more of the slots 322 that are arranged circumferentially around the sidewalls 323 of the container 320. As seen in FIGS. 3A-3D, there are 3 sets of slots 322 arranged circumferentially around the sidewalls 323 of the container 320 at 3 different locations. The number of slots 322 and the width of the slots 322 can be selected such that a given flange 312 can fit within a corresponding slot 322. Moreover, the breakable tabs or voids 315 can align with the solid portions of the sidewalls 323 that are located between the slots 322.

Figure 3D:
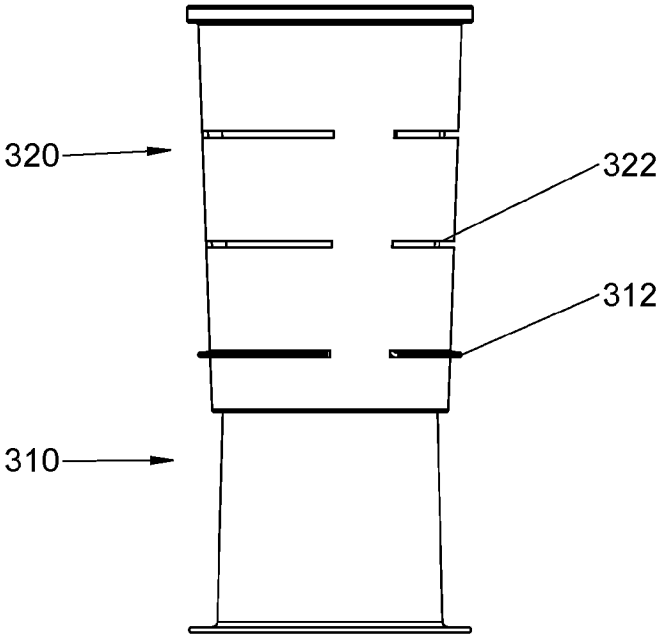
Figure 3C:
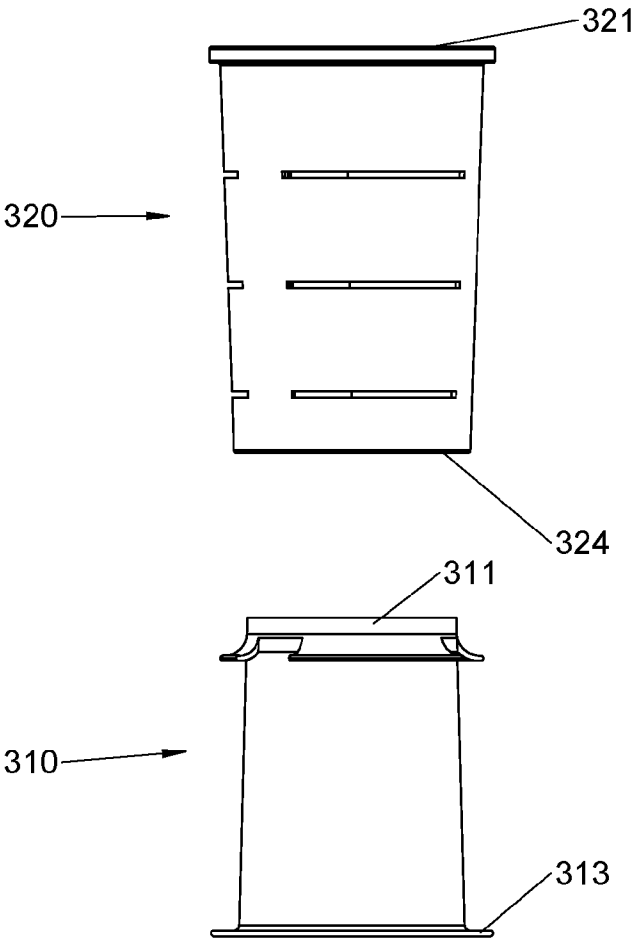
Figure 4B:
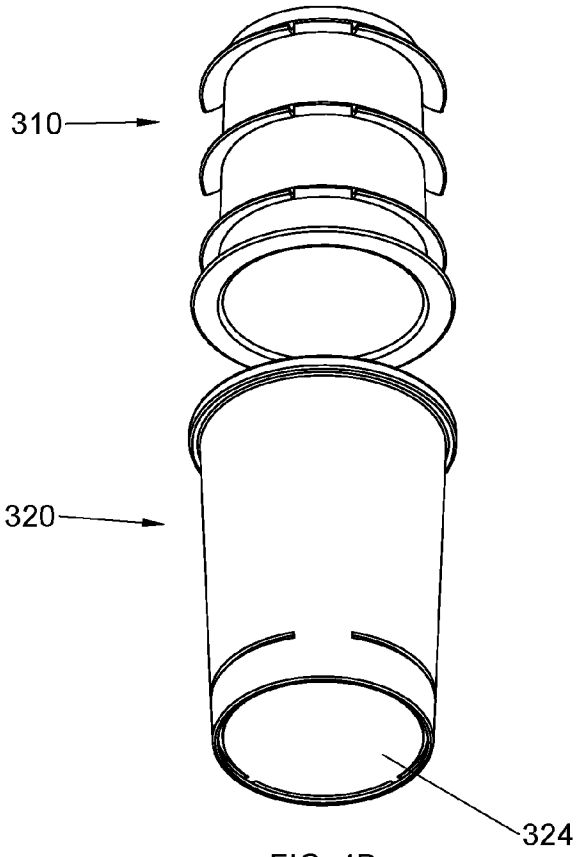
FIGS. 4A-4D are perspective and cross-sectional views of a food container device according to certain other embodiments.
Figure 4A:
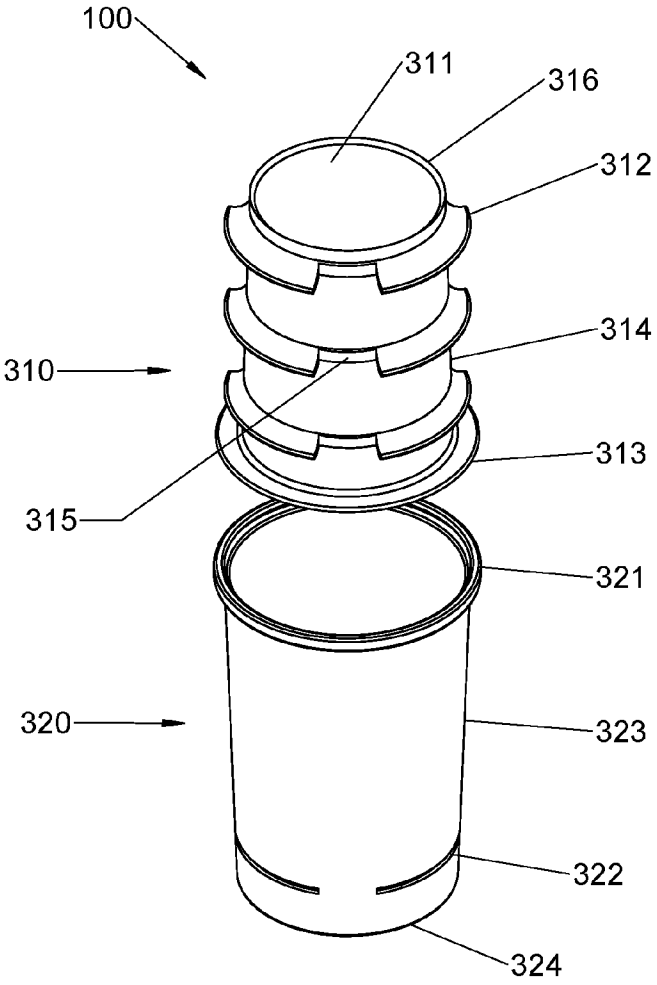
Figure 4D:
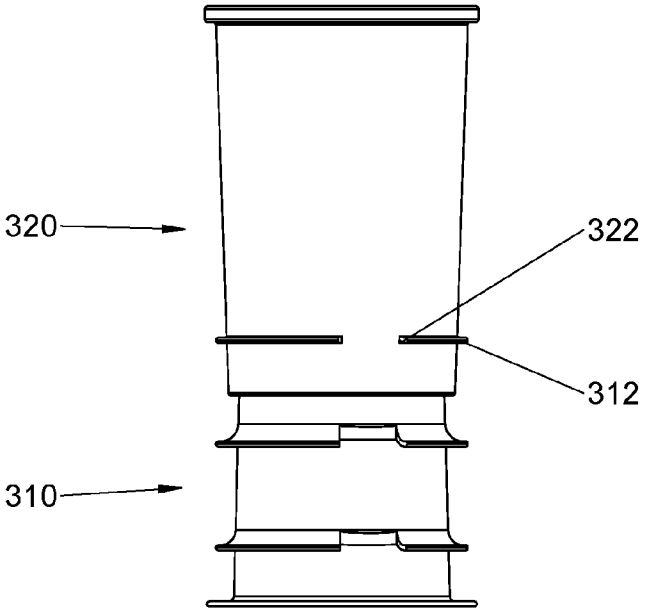
Figure 4C:
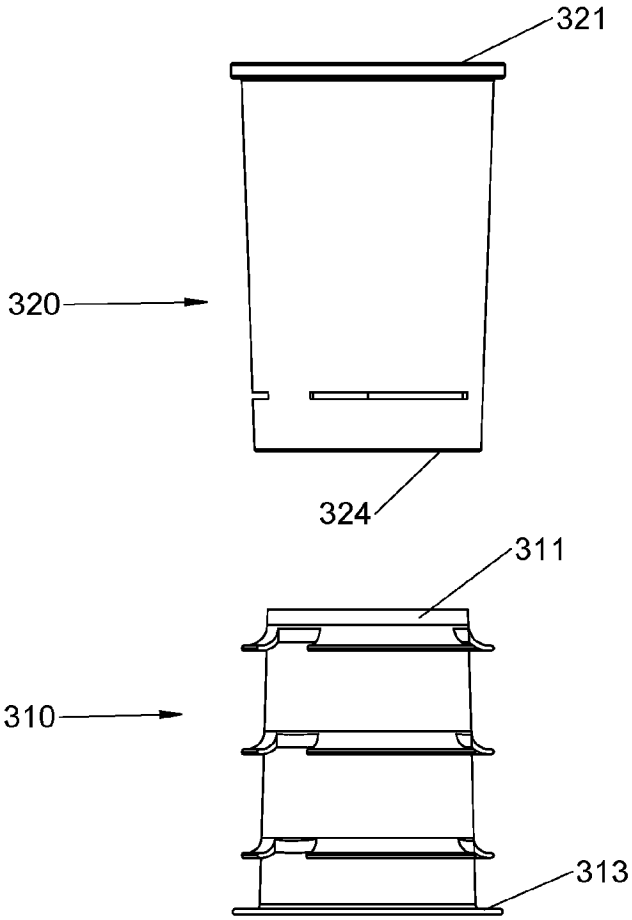

Turning to FIGS. 3C and 3D, when the consumer desires to consume the non-liquid food product, the consumer can remove the actuator 310 from the top of the container 320 and insert the top end 311 of the actuator 310 into the bottom end 324 of the container 320. The top end 311 of the actuator 310 can break the breakable tabs 315 (if present) or break through the bottom of the container 320; thus leaving just the flanges 312. The food product can be pushed upwards to the top end 321 of the container 320 for consumption by self-actuating the actuator 310 in an upward movement. As the actuator 310 is moved upwards through the container 320, the flanges 312 can mate with and fit within the slots 322 of the container 320. This mating engagement can prevent downward movement of the food product and the actuator 310.

FIGS. 4A-4D depict a food container device 100 similar to the device depicted in FIGS. 3A-3D, except that the actuator 310 includes 3 sets of flanges 312 located at 3 different locations on the sidewalls 314, and the container 320 includes 1 set of slots 322 near the bottom end 324 of the container 320.

Figure 5A:
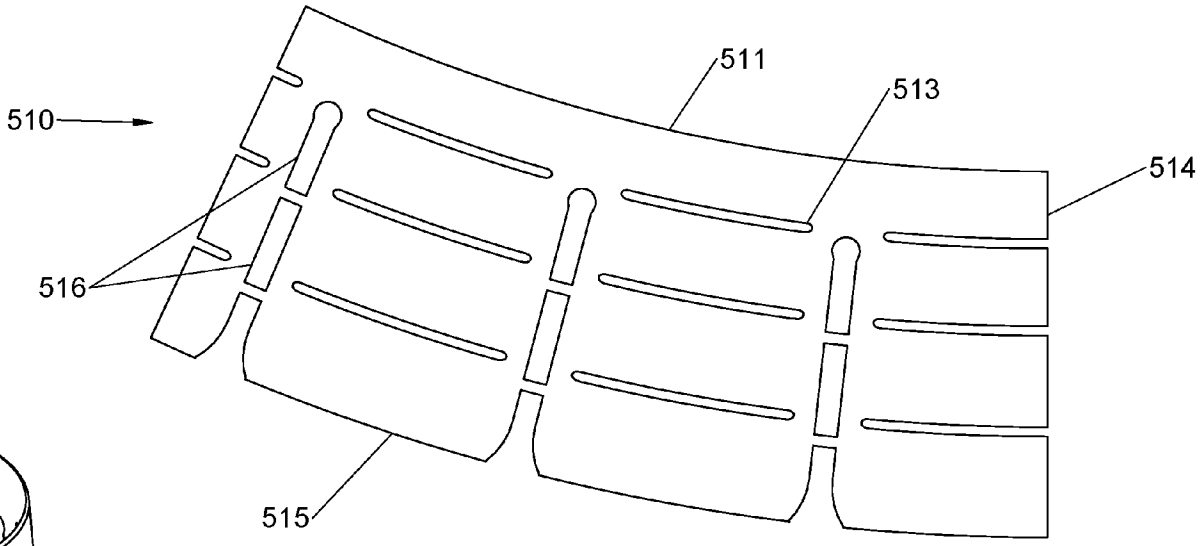
FIG. 5A is a front view of a pre-assembled actuator of a food container device according to certain embodiments.
Figure 5C:
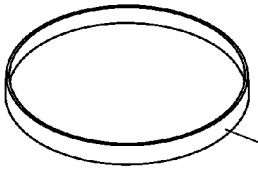
FIG. 5C is a perspective view of a cap for the actuator of FIGS. 5A and 5B.
Figure 5B:
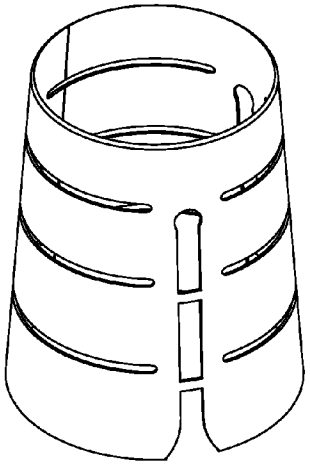
FIG. 5B is a perspective view of the actuator of FIG. 5A assembled.

FIGS. 5A-5K depict a food container device 100 according to certain other embodiments. FIG. 5A depicts an actuator 510 in a pre-assembled state. The actuator 510 can include a top end 511, sidewalls 514, and a bottom end 515. The actuator 510 can also include one or more sets of vertically spaced cutouts 516 located around the circumference of the actuator 510. The actuator 510 can also optionally include one or more sets of horizontal slots 513 located between the sets of cutouts 516. At least one end of the sidewall 514 can include an adhesive material running along the majority or entirety of the end of the sidewall. The adhesive material can be covered with a non-adhesive covering to prevent premature adhesion to an object. The non-adhesive covering can be removed prior to assembly of the actuator 510. The one adhesive end of the sidewall 514 can be moved to overlap the opposite end of the sidewall 514 to create an assembled actuator 510, as shown in FIG. 5B. As shown in FIG. 5C, a cap 517 with a rim 518 can be inserted into the top end 511 of the actuator 510. The rim 518 can also include an adhesive material that allows the cap 517 to remain affixed within the top end 511 of the actuator 510.

Figures 5D, 5E, 5F, 5G:
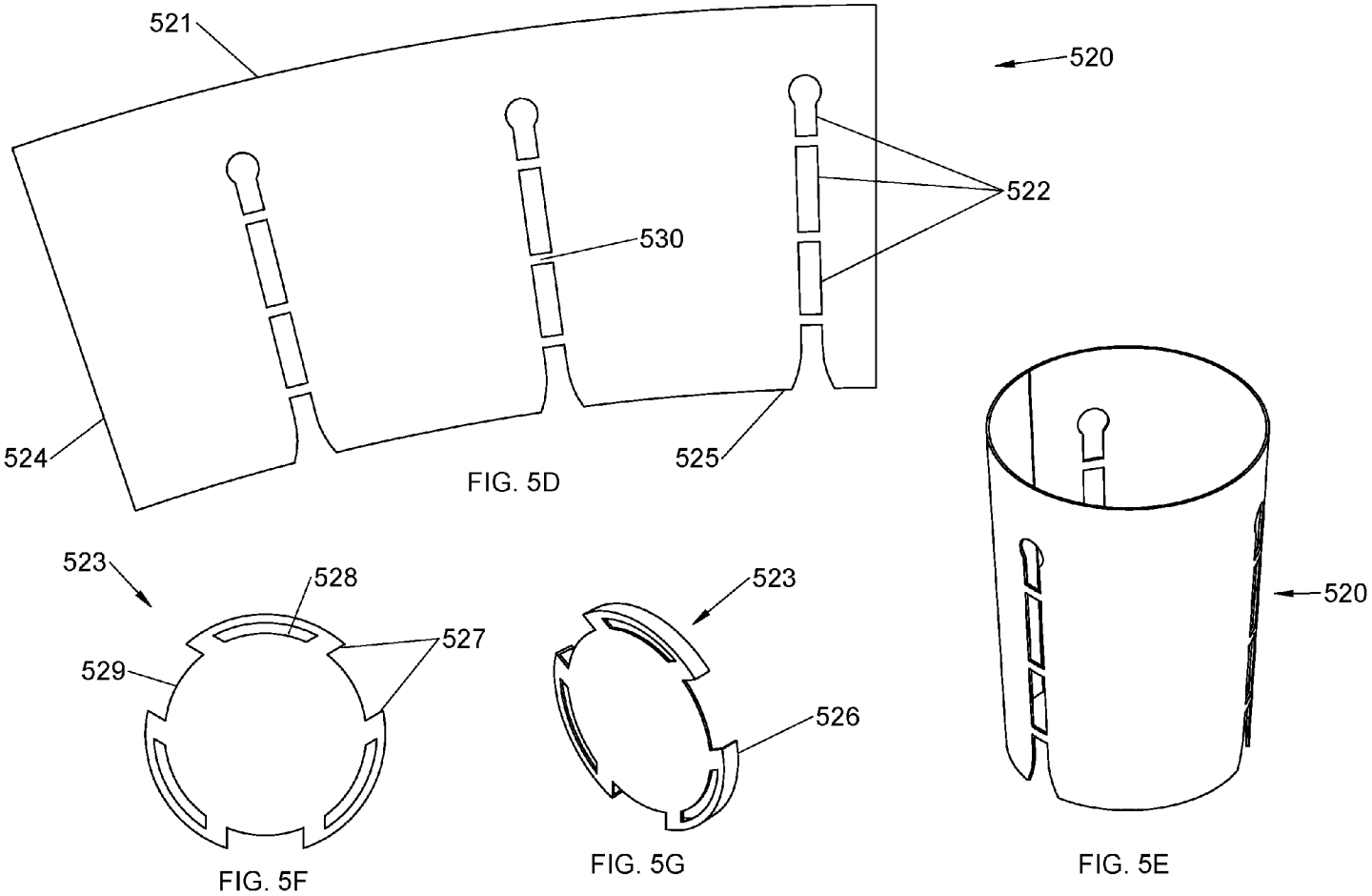
FIG. 5D is a front view of a pre-assembled container of a food container device according to certain embodiments.
FIG. 5E is a perspective view of the container of FIG. 5D assembled.
FIG. 5F is a top view of a cap for the container of FIGS. 5D and 5E.
FIG. 5G is a perspective view of the cap of FIG. 5F.
Figure 5I:
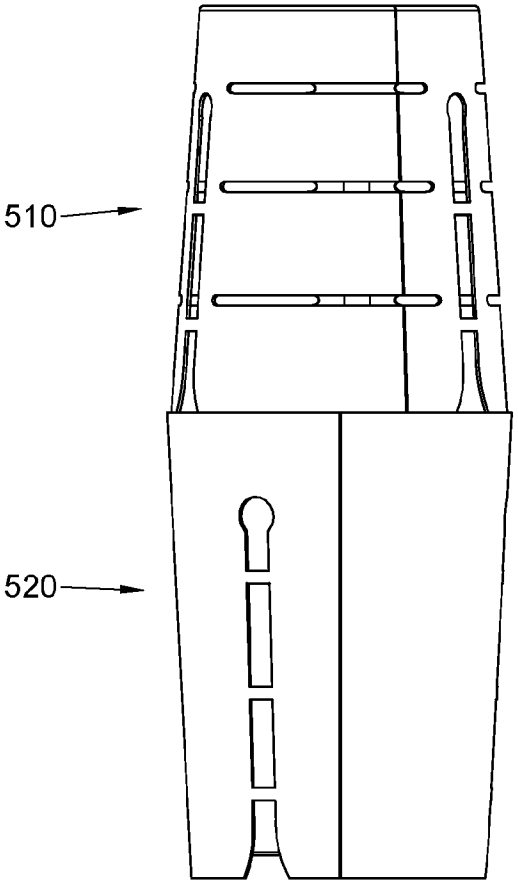
FIGS. 5H-5K are perspective and cross-sectional views of the food container device of FIGS. 5A-5G.

FIG. 5D depicts a container 520 in a pre-assembled state. The container 520 can include a top end 521, sidewalls 524, and a bottom end 525. The container 520 can also include one or more sets of vertically spaced cutouts 522 located around the circumference of the container 520 with breakable tabs 530 being located between the empty spaces of the cutouts. At least one end of the sidewall 524 can include an adhesive material running along the majority or entirety of the end of the sidewall. The adhesive material can be covered with a non-adhesive covering to prevent premature adhesion to an object. The non-adhesive covering can be removed prior to assembly of the container 520. The one adhesive end of the sidewall 524 can be moved to overlap the opposite end of the sidewall 524 to create an assembled container 520, as shown in FIG. 5E. As shown in FIGS. 5F and 5G, a cap 523 with a rim 526 can be inserted into the bottom end 525 of the container 520. The rim 526 can also include an adhesive material that allows the cap 523 to remain affixed within the bottom end 525 of the container 520. The cap 523 can also include a base 529, one or more cutouts 528, and flanges 527.

Figure 5H:
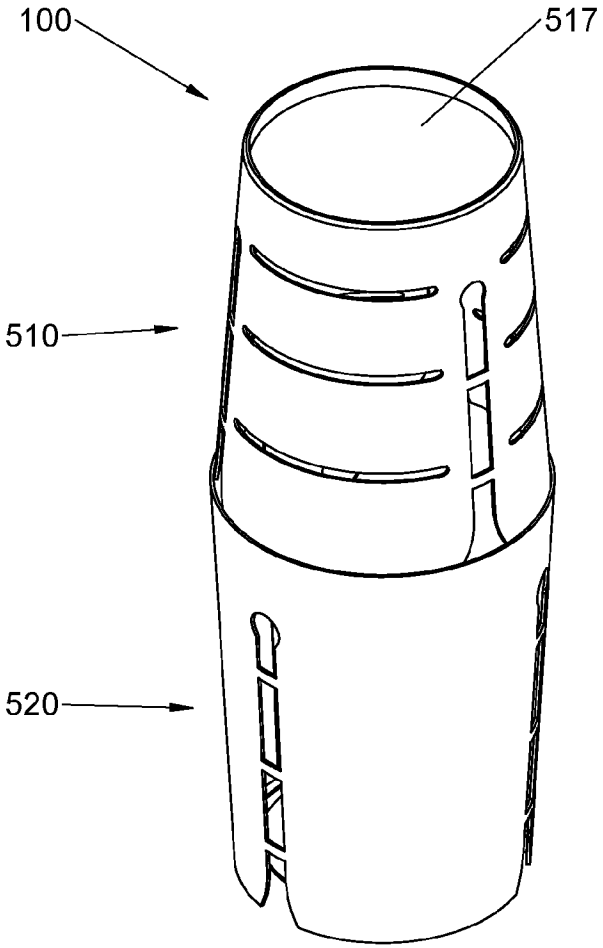

As seen in FIGS. 5H and 51, the actuator 510 is operatively connected on top of the container 520. In this manner, a food product can be placed inside the container 520 and then the actuator 510 can be placed on top of the container 520 to be given to a consumer. The food product can then be transported to another location.

Figure 5K:
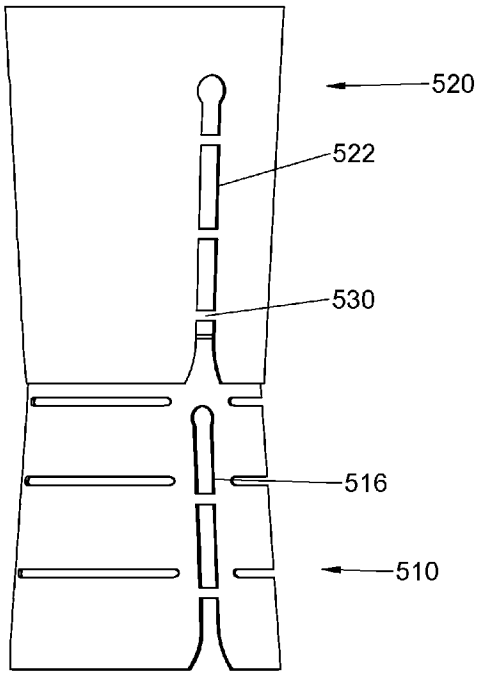
Figure 5J:
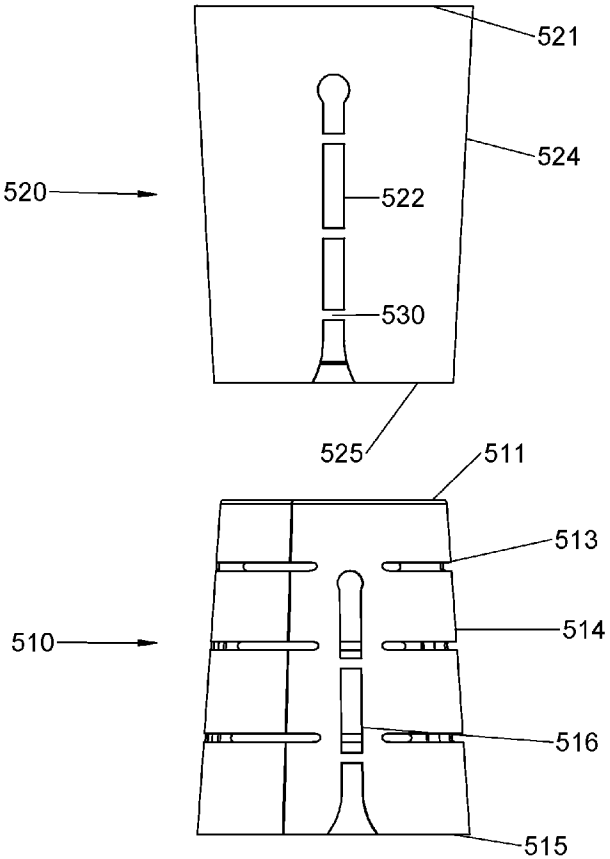

Turning to FIGS. 5J and 5K, when the consumer desires to consume the non-liquid food product, the consumer can remove the actuator 510 from the top of the container 520 and insert the top end 511 of the actuator 510 into the bottom end 525 of the container 520. The cap 517 of the actuator 510 can break the base 529 of the container via breakage of the cutouts 528; thus leaving the rim 526 and the flanges 527 affixed to the bottom end 525 of the container 520. The food product can be pushed upwards to the top end 521 of the container 520 for consumption by self-actuating the actuator 510 in an upward movement. The inverse conical shape of the actuator 510 and the container 520 can create tension as the actuator 510 is pushed upwards through the container 520. This tension can force the breakable tabs 530 outwards away from the sidewall 524 of the container 520. As the tension increases, the breakable tabs 530 can break. The tension created can also prevent downward movement of the food item and the actuator 510. If the actuator 510 includes the slots 513, then the flanges 527 can mate with and fit within the slots 513 of the actuator 510. This mating engagement can also help prevent downward movement of the food product and the actuator 510.

Figure 6A:
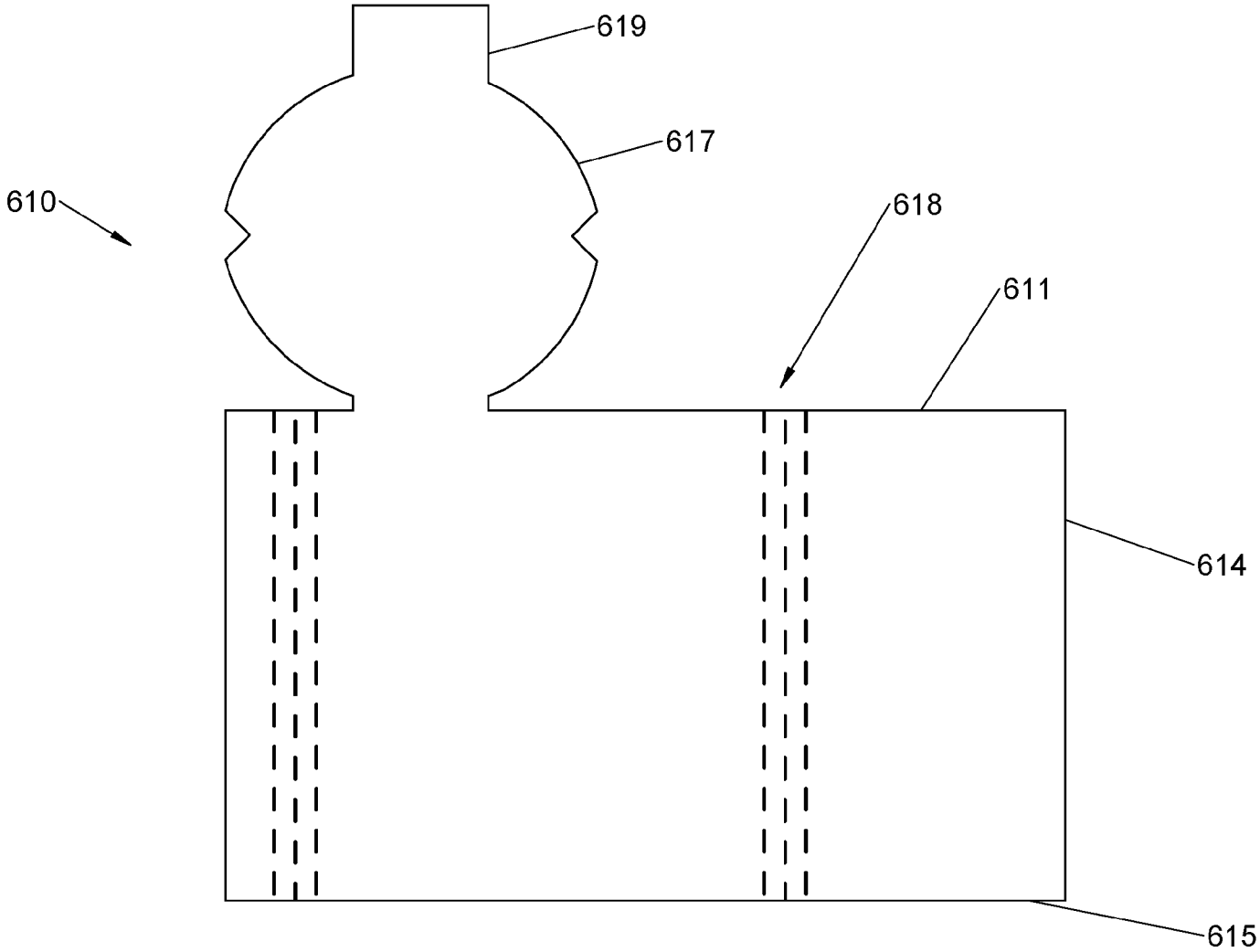
FIG. 6A is a front view of a pre-assembled actuator of a food container device according to certain embodiments.
Figure 6B:
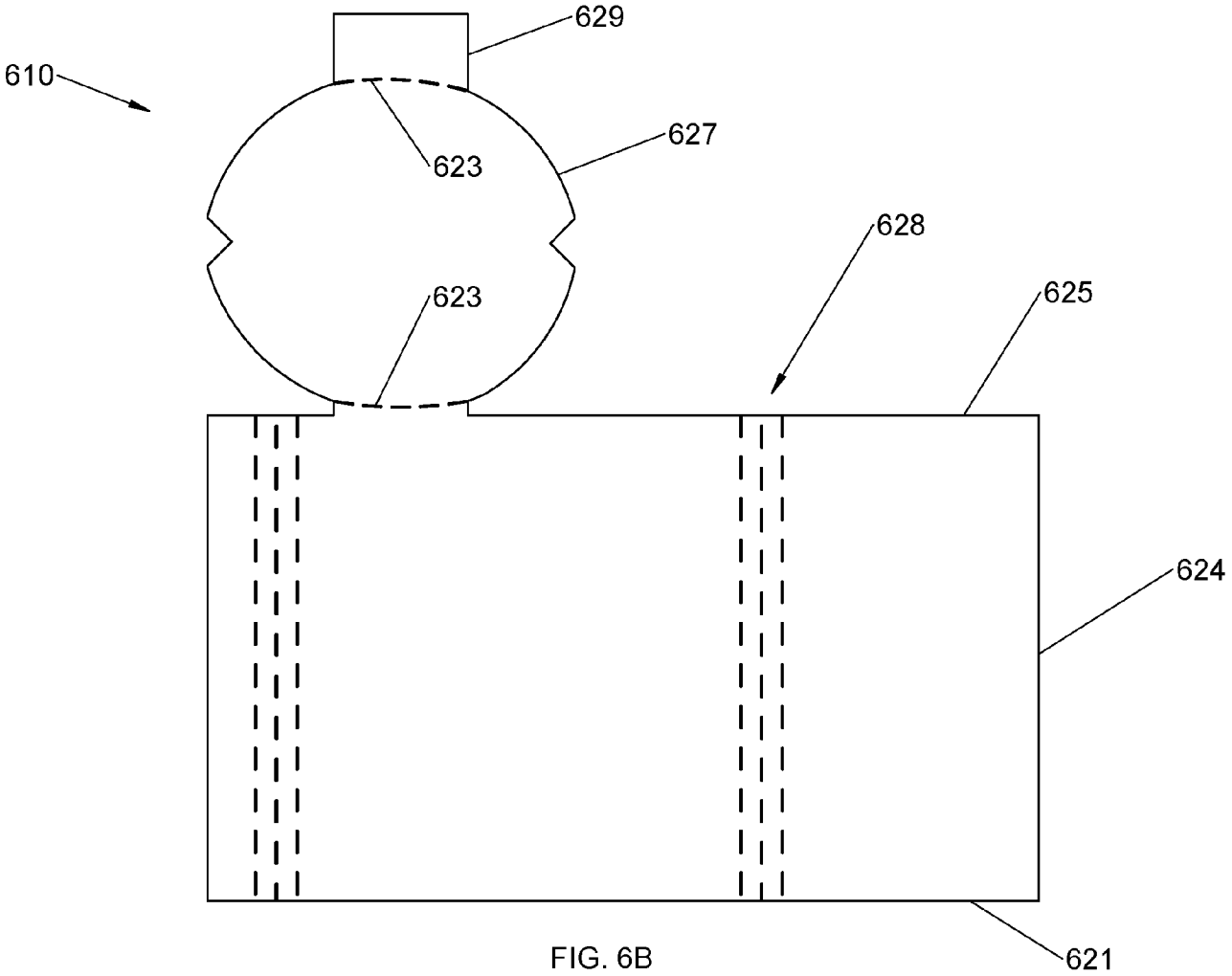
FIG. 6B is a front view of a pre-assembled container of a food container device according to certain embodiments.
Figures 6C, 6D, 6E:
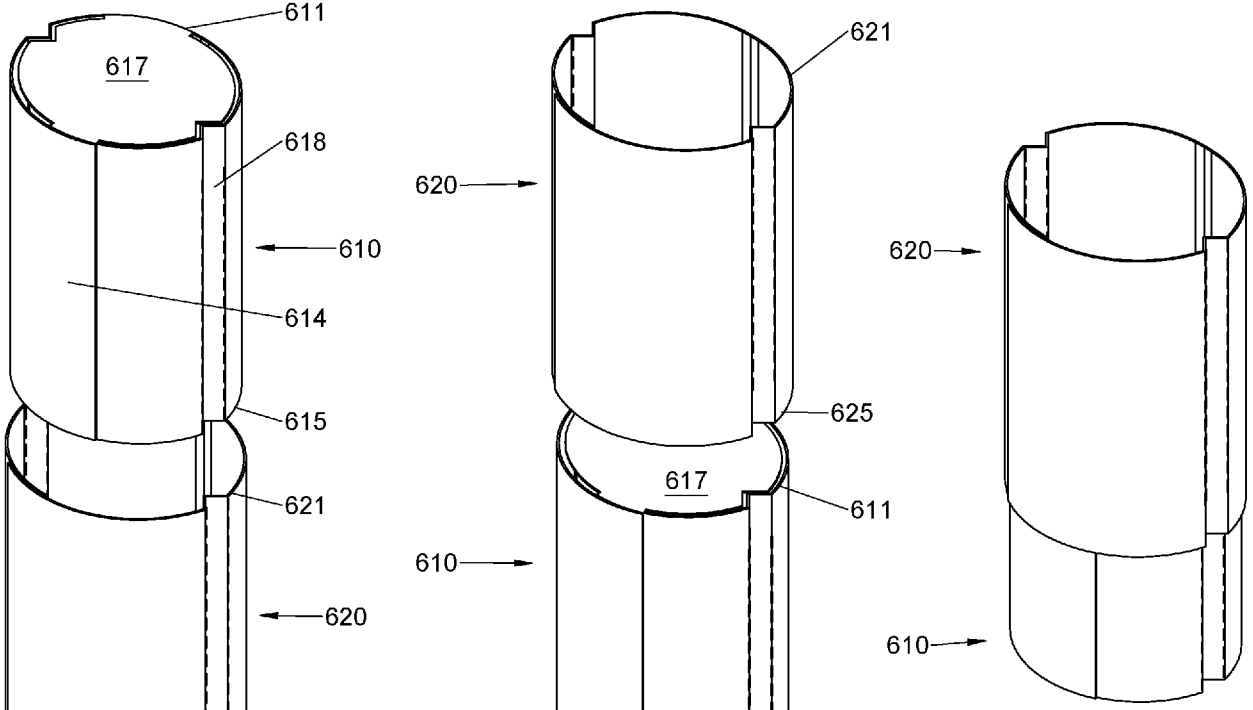
FIGS. 6C-6E are perspective views of the actuator and container of FIGS. 6A and 6B assembled.

FIGS. 6A-6E depict a food container device 100 according to certain other embodiments. FIG. 6A depicts an actuator 610 in a pre-assembled state. The actuator 610 can include a top end 611, sidewalls 614, and a bottom end 615. The actuator 610 can also include one or more sets of vertically spaced folds 618 located parallel to the ends of the sidewalls 614. The folds 618 can be perforated or scored. At least one end of the sidewall 614 can include an adhesive material running along the majority or entirety of the end of the sidewall. The adhesive material can be covered with a non-adhesive covering to prevent premature adhesion to an object. The non-adhesive covering can be removed prior to assembly of the actuator 610. The one adhesive end of the sidewall 614 can be moved to overlap the opposite end of the sidewall 614 to create an assembled actuator 610, as shown in FIGS. 6C-6E. The actuator 610 can include a lid 617 with a tab 619. All or a portion of the tab 619 can also include an adhesive material that allows the lid 617 to be affixed to the top end 611 of the actuator 610 during assembly.

FIG. 6B depicts a container 620 in a pre-assembled state. The container 620 can include a top end 621, sidewalls 624, and a bottom end 625. The container 620 can also include one or more sets of vertically spaced folds 628 located parallel to the ends of the sidewalls 624. The folds 628 can be perforated or scored. At least one end of the sidewall 624 can include an adhesive material running along the majority or entirety of the end of the sidewall. The adhesive material can be covered with a non-adhesive covering to prevent premature adhesion to an object. The non-adhesive covering can be removed prior to assembly of the container 620. The one adhesive end of the sidewall 624 can be moved to overlap the opposite end of the sidewall 624 to create an assembled container 620, as shown in FIGS. 6C-6E. The container 620 can include a base 627 with a tab 629. The base 627 can include perforations to allow breakage of the base 627 from the container 620 during self-actuation. All or a portion of the tab 629 can also include an adhesive material that allows the base 627 to be temporarily affixed to the bottom end 625 of the container 620 during assembly.

As seen in FIG. 6C, the actuator 610 can be operatively connected on top of the container 620. In this manner, a food product can be placed inside the container 620 and then the actuator 610 can be placed on top of the container 620 to be given to a consumer. The food product can then be transported to another location.

Turning to FIGS. 6D and 6E, when the consumer desires to consume the non-liquid food product, the consumer can remove the actuator 610 from the top of the container 620 and insert the top end 611 of the actuator 610 into the bottom end 625 of the container 620. The lid 617 of the actuator 610 can break the base 627 of the container via breakage of the perforations 623; thus leaving the tab 629 affixed to the bottom end 625 of the container 620. The food product can be pushed upwards to the top end 621 of the container 620 for consumption by self-actuating the actuator 610 in an upward movement. The shape of the actuator 610 and container 620 that is created by the folds 618/628 can create tension as the actuator 610 is pushed upwards through the container 620. The tension created can prevent downward movement of the food item and the actuator 610 during consumption of the food product.

Figure 7A:
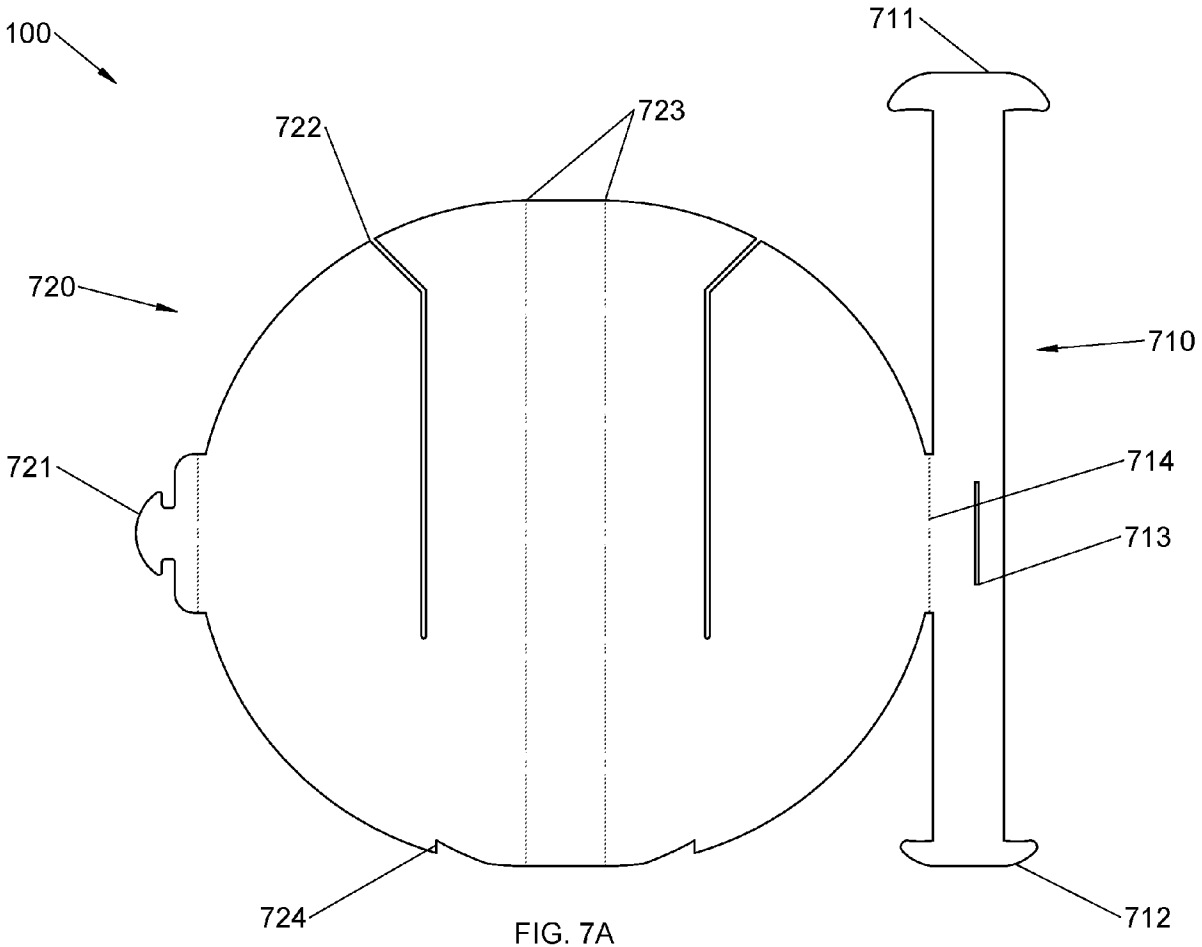
FIG. 7A is a top view of a pre-assembled food container device according to certain embodiments.

FIGS. 7A-8B depict a food container device 100 according to certain other embodiments, and show a half-moon shaped container that may be useful for housing tacos. FIG. 7A shows a pre-assembled food container device 100. The food container device 100 can include a container 720 and an actuator 710. The container 720 can include a tab 721, two slide channels 722, one or more folds 723, and a closing channel 724. The actuator 710 can include a slide tab 711, a closing tab 712, a slot 713, and a fold 714. The folds 723/714 can be perforated or scored for ease in folding the container 720 during assembly.

Figure 7C:
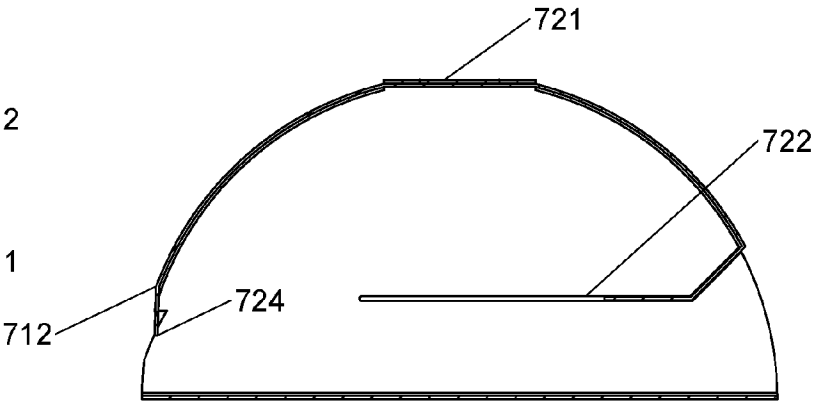
FIG. 7C is a cross-sectional view of the device of FIG. 7B taken along lines 7-7.
Figure 7D:
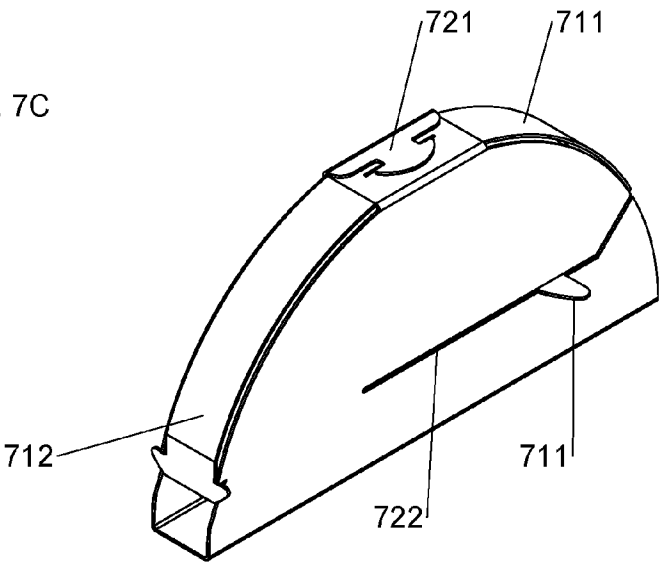
FIG. 7D is a perspective view of the assembled device of FIGS. 7A-7C.
Figure 7B:
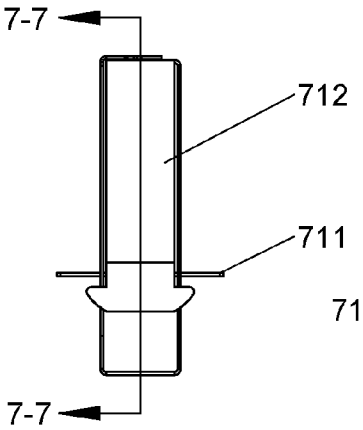
FIG. 7B is a front view of the food container device of FIG. 7B assembled.

FIGS. 7B-7D depict the food container device 100 assembled. During assembly, the container 720 can be folded along the folds 723; thus creating a base for housing the food product, such as a taco. The folds 723 can be spaced apart a desired distance in order to accommodate the width of the food product. The food product can be inserted into the container 720. The actuator 710 can then be folded over the container 720 via fold 714. The tab 721 can be inserted into slot 713. The closing tab 712 can be temporarily inserted into the closing channel 724. Slide tab 711 can be engaged with the slide channels 722. The food product can be transported to another location.

When the consumer desires to consume the food product, the actuator 710 can be self-actuated by the consumer moving the slide tab 711 via one or both edges of the slide tab through the slide channels 722. As the food product is advanced towards the front of the container 720, the closing tab 712 becomes disengaged from the closing channel 724 to create an opening in the container 720. The closing tab 712 can move upwards to create a larger opening as more of the food product is advanced through the container 720 via self-actuation of the actuator 710.

Figure 8A:
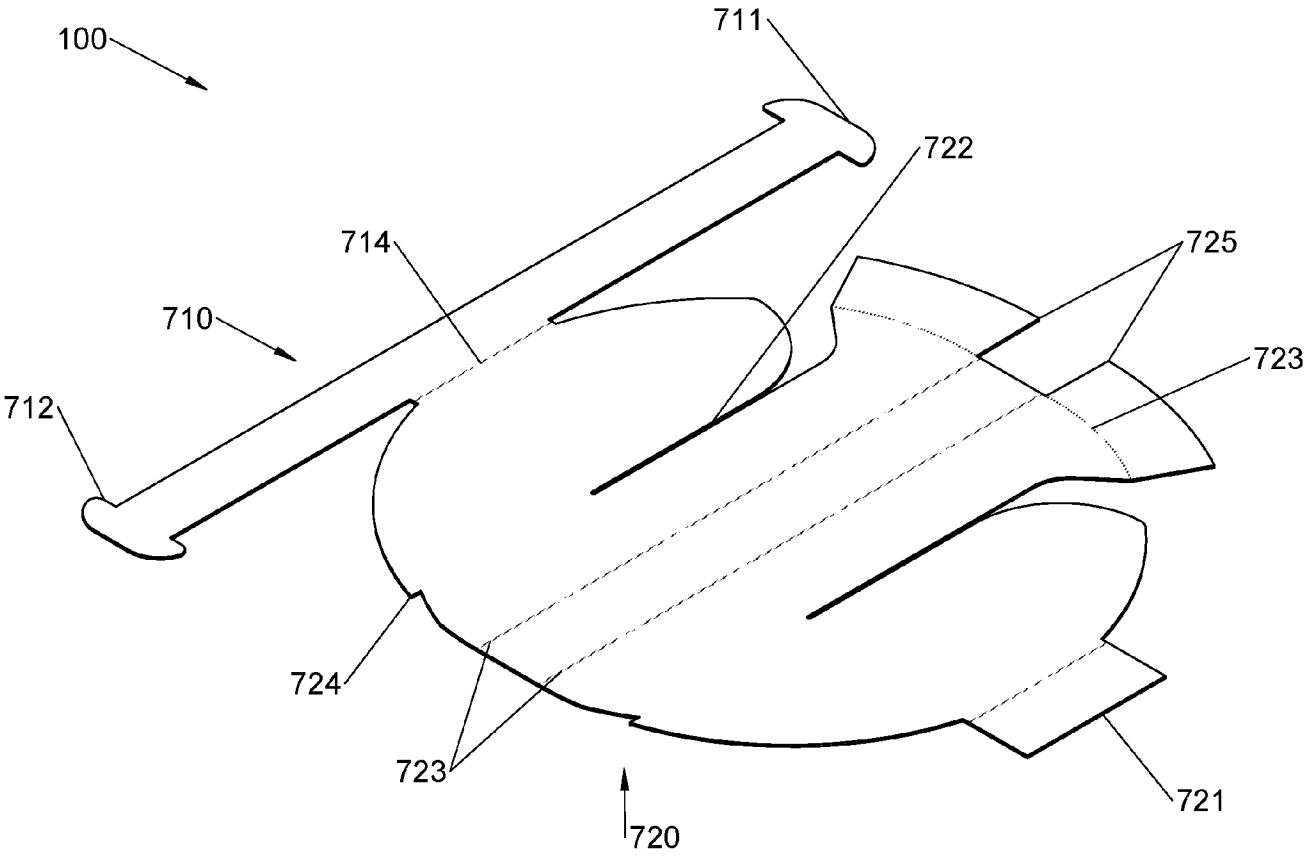
FIG. 8A is a top view of a pre-assembled food container device according to certain embodiments.
Figure 8C:
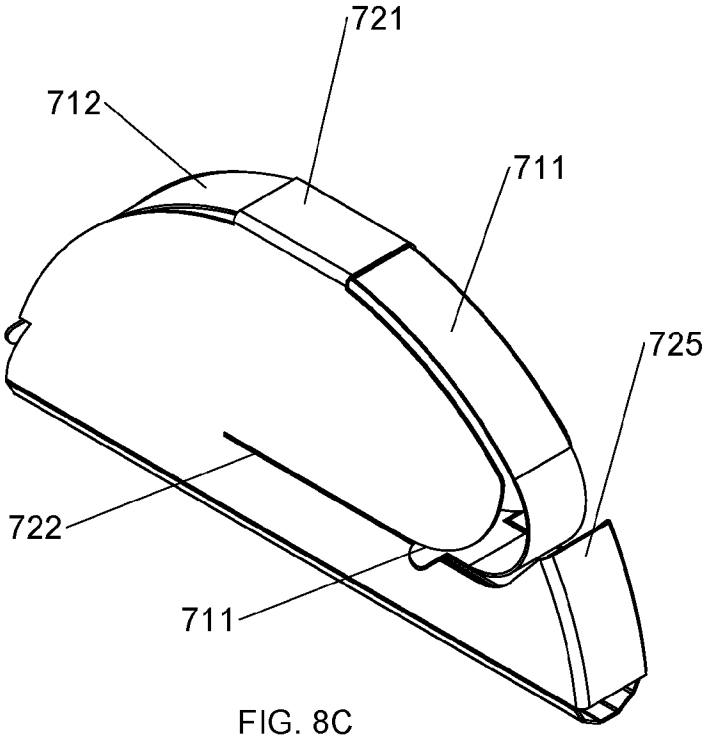
FIGS. 8B and 8C are perspective views of the assembled device of FIG. 8A.
Figure 8B:
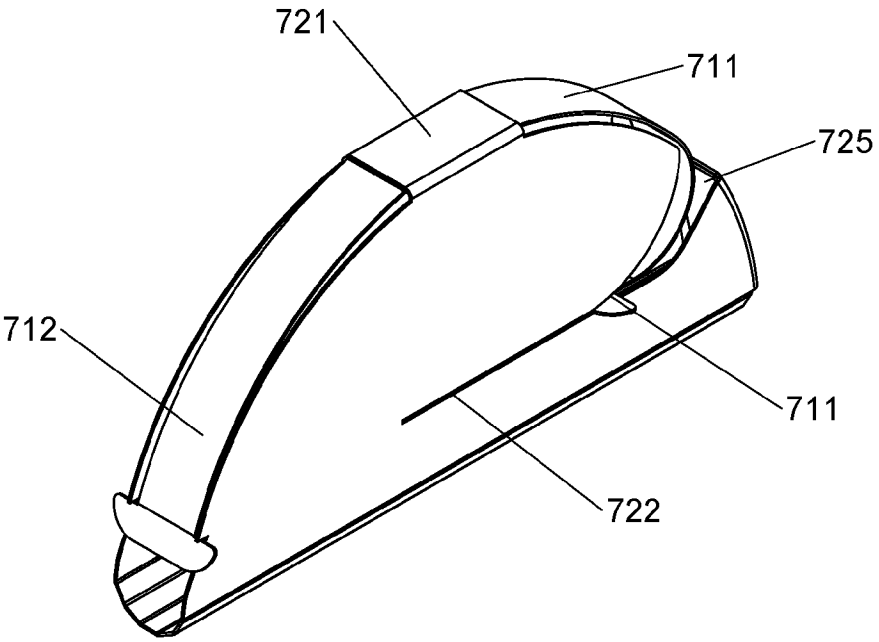

FIGS. 8A-8C depict a food container device 100 similar to FIGS. 7A-7D with the addition of 2 rear closing tabs 725. During assembly, the rear closing tabs 725 can be positioned on top of one another and affixed via an adhesive material.

FIGS. 9A-13C depict a food container device 100 according to certain other embodiments, and show a rectangular-shaped container that may be useful for housing square-, circular-, or rectangular-shaped food products, such as pizzas and hamburgers. Although these embodiments illustrate a rectangular-shaped container, it is to be understood that the container can also be square-shaped.

The food container device 100 of FIGS. 9A-9E includes an actuator 910 and a container 920. The actuator 910 can include a flange 912 located at each end of the actuator 910. The actuator 910 can also include a rim 911, an actuator slide slot 913, and actuator holes 914. Although the actuator holes 914 are shown as being circular in shape, the holes can have any geometric shape including, but not limited to, square, rectangular, or triangular. A food product can be inserted into the container 920 and the actuator 910 fitted onto a front end 930 of the container 920.

Figure 9B:
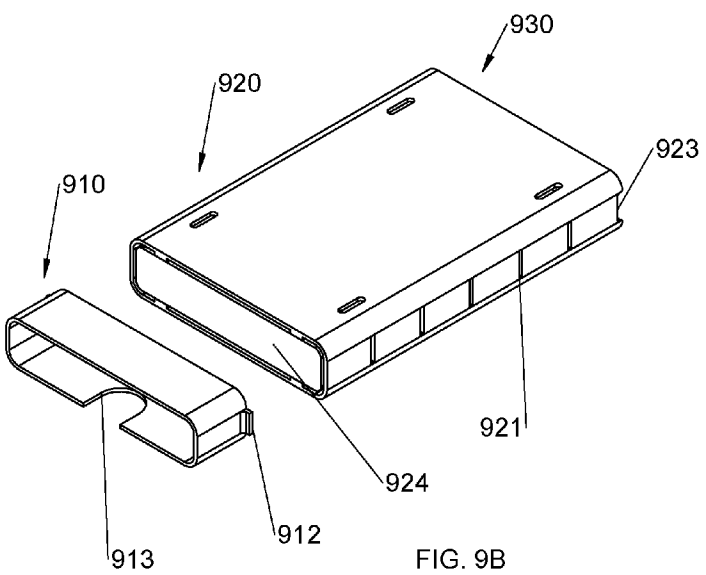
FIG. 9B is an upper perspective view of the food container device of FIG. 9A showing an actuator disengaged from a container.
Figure 9A:
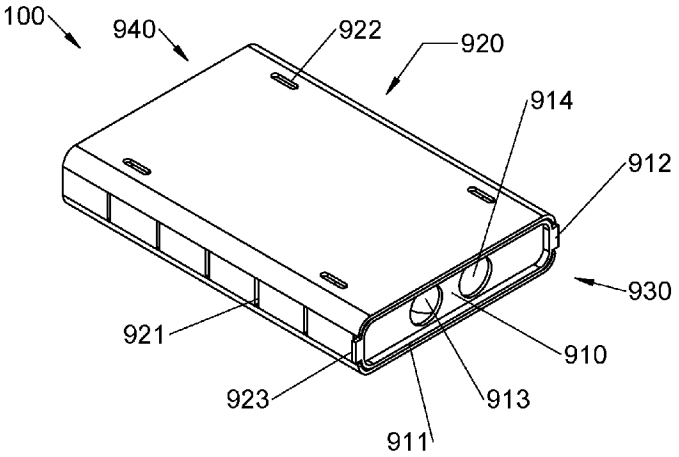
FIG. 9A is an upper perspective view of a food container device according to certain embodiments.
Figure 9C:
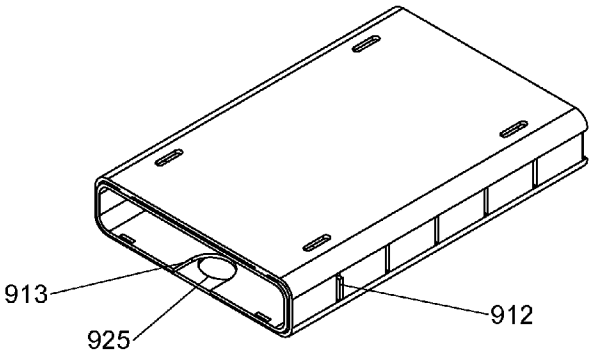
FIG. 9C is an upper perspective view of the food container device of FIG. 9B showing the actuator engaged with the container from the back of the container.

The container 920 can include an inset 923, whereby the inset can allow a consumer to remove the actuator 910 via grasping the flanges 912 and pulling the actuator 910 away from the front end 930 of the container 920. The actuator 910 can also be removed by engaging the actuator holes 914 with the consumer's fingers or other object. Once the actuator 910 is removed from the front end 930 of the container 920, it can be positioned adjacent to a perforated base 924 located at a back end 940 of the container 920 (for example, as shown in FIG. 9B). As shown in FIG. 9C, the actuator 910 can be pushed into the container 920 from the back end 940, thereby breaking the perforated base 924 and allowing movement of the food product and the actuator 910 through the container 920. As shown in FIG. 9E, movement of the food product and the actuator 910 can be accomplished by a consumer utilizing a container slide slot 925 that is located on the bottom of the container 920 to push the actuator towards the front end 930 of the container 920. The container 920 can include one or more vertical slots 921 along sidewalls of the container 920. The number of slots 921 and the height of the slots 921 can be selected such that flanges 912 can fit within a corresponding slot 921. As the actuator 910 is moved forwards through the container 920, the flanges 912 can mate with and fit within the slots 921 of the container 920. This mating engagement can prevent backward movement of the food product and the actuator 910.

Figure 9D:
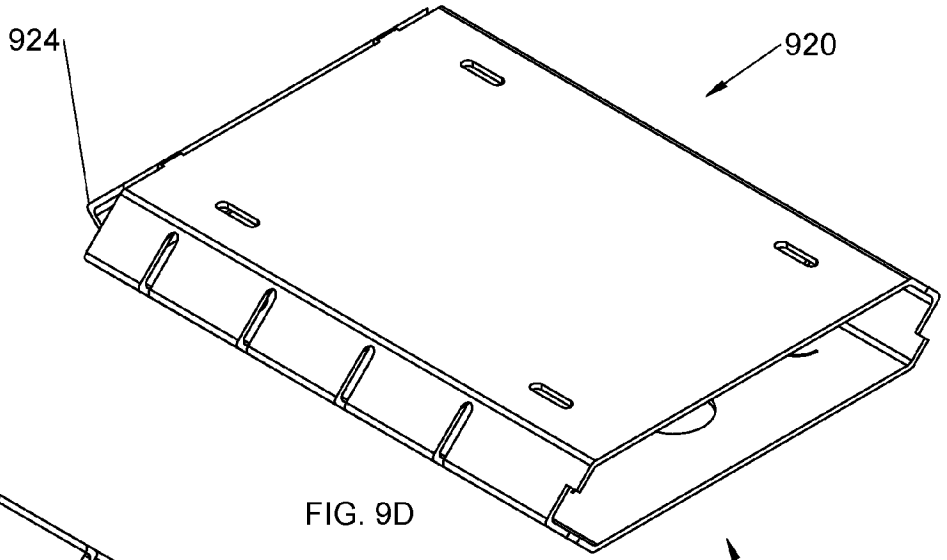
FIG. 9D is an upper perspective view of the food container device of FIG. 9A in a collapsed representation.
Figure 9E:
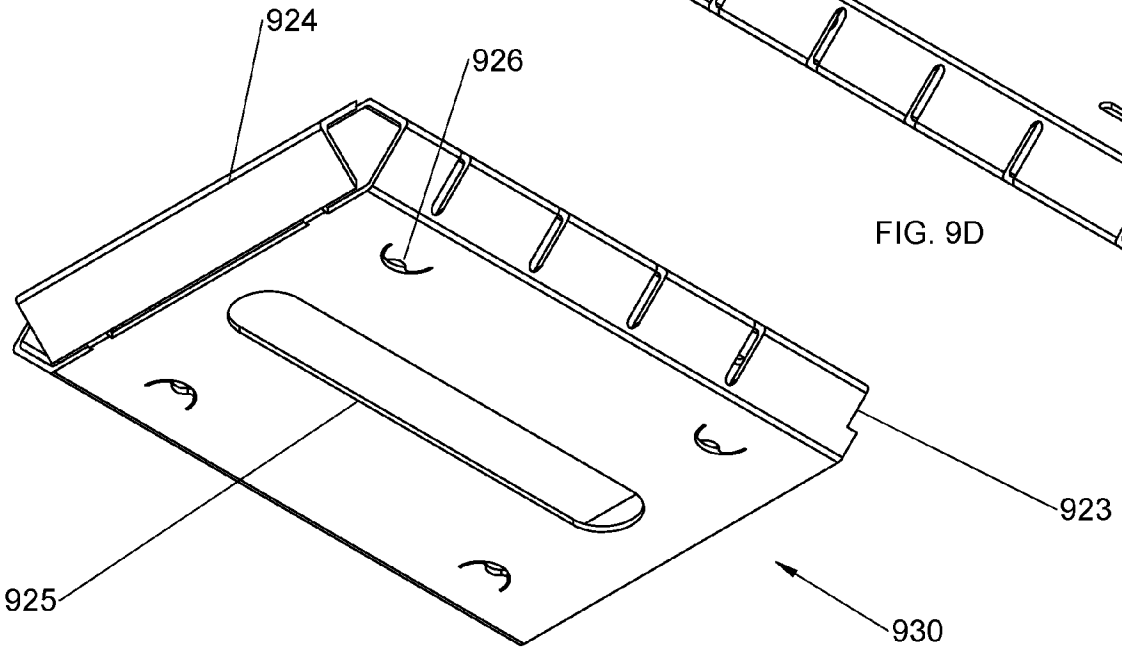
FIG. 9E is a lower perspective view of the food container device of FIG. 9A in a collapsed representation.

FIG. 9D shows a top view of the food container device 100 in a partially collapsed state. FIG. 9E shows a bottom view of the food container device 100 in a partially collapsed position. The top of the container 920 can include one or more stack slots 922 that can receive one or more male standoffs 926 to allow multiple containers 920 to be stacked together for storage prior to use. Standoffs 926 can also be used by a consumer for stacking multiple food container devices while transporting the devices in a vehicle or carrying the devices.

Figure 10A:
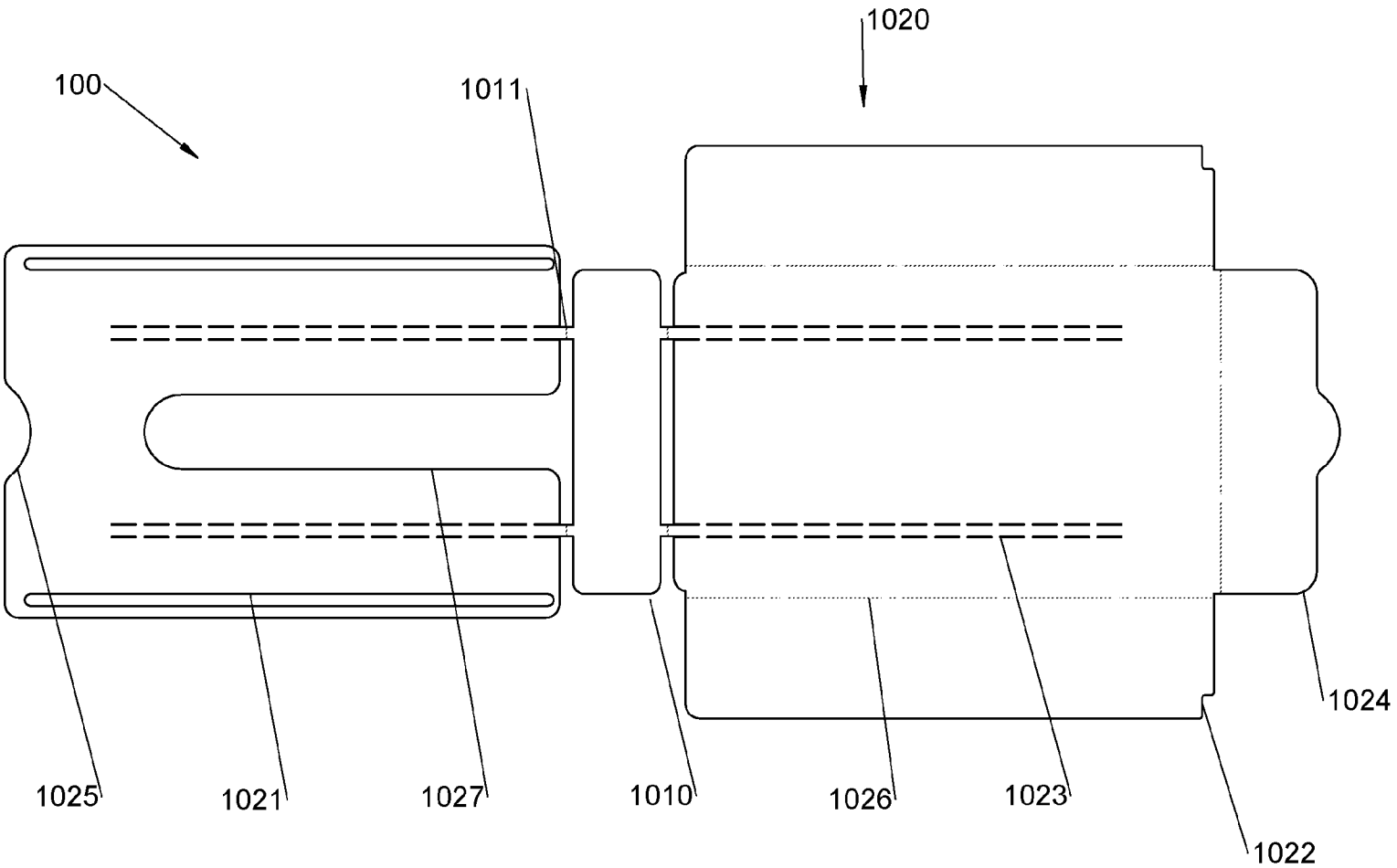
FIG. 10A is a top view of a pre-assembled food container device according to certain embodiments.

FIG. 10A depicts a food container device 100 according to certain other embodiments in a pre-assembled state. The food container device 100 includes an actuator 1010 and a container 1020. The actuator 1010 can be operatively connected to a top and bottom of the container 1020 and forming a back end of the container via breakable tabs 1011. A bottom of the container 1020 can include stabilizing grooves 1021 running parallel to one or both sides of the bottom adjacent to the edge of the sides. The bottom can also include a closing channel 1025 located at the front of the bottom of the container; an actuator slide slot 1027 located near the middle of the bottom and extending partly or wholly from the back to the front of the bottom; and one or more actuator stabilizing perforations 1023 that run parallel to the stabilizing grooves 1021 at a location between the stabilizing grooves 1021 and the actuator slide slot 1027.

A top of the container 1020 can include a closing tab 1024, actuator stabilizing perforations 1023 that align with the actuator stabilizing perforations 1023 on the bottom of the container 1020 when the food container device 100 is assembled, one or more folds 1026, and a notched stabilizer 1022 located at the corners of a front end of the container 1020 and the tops of the sidewalls of the assembled container. The folds 1026 can be perforated or scored for ease in folding the container 1020 during assembly. All or a portion of the edges of the sidewalls on the top of the container 1020 can include an adhesive material running along the majority or entirety of the length of the edge. The adhesive material can be covered with a non-adhesive covering to prevent premature adhesion to an object. The non-adhesive covering can be removed prior to assembly of the container 1020. Sidewalls can be formed during assembly by folding the walls upward or downward via the parallel folds 1026. The adhesive portion of the sidewalls can be moved to overlap the edges of the bottom to create an assembled container 1020.

Figure 10C:
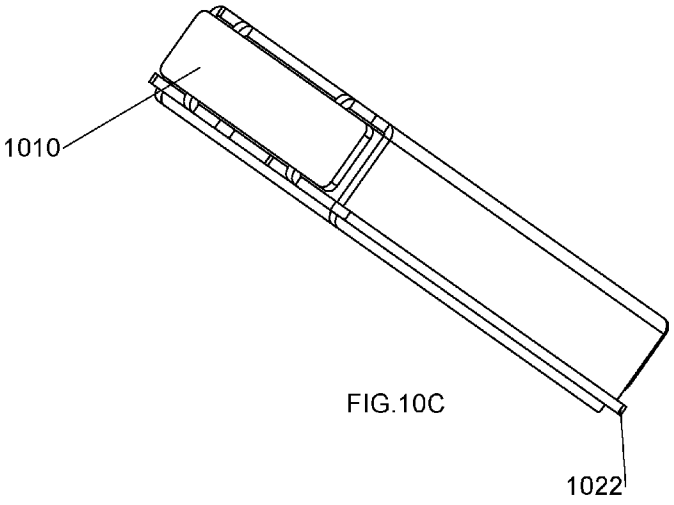
FIG. 10C is a back perspective view of the food container device of FIG. 10A assembled.
Figure 10D:
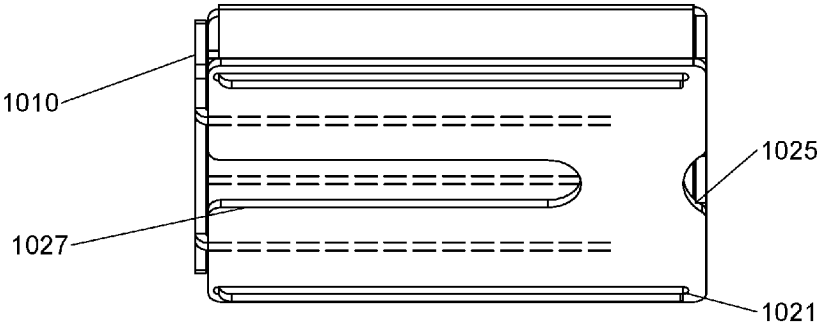
FIG. 10D is a lower perspective view of the food container device of FIG. 10A assembled.
Figure 10B:
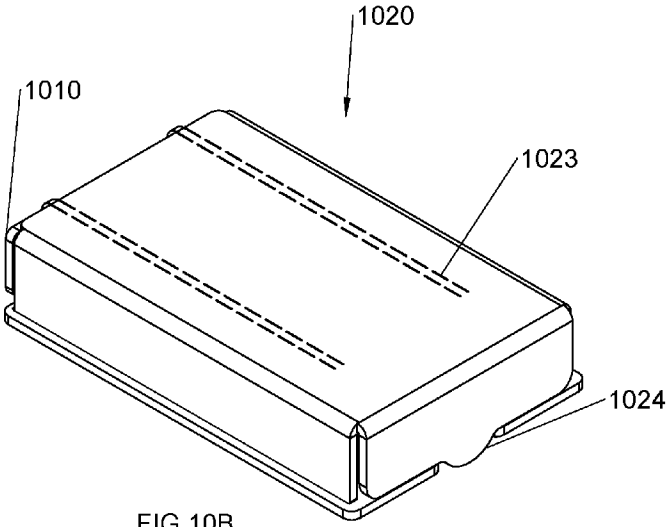
FIG. 10B is an upper perspective view of the food container device of FIG. 10A assembled.

FIG. 10B is a top, front view of the assembled container 1020. FIG. 10C is a back, side view of the assembled container 1020; while FIG. 10D is a bottom, side view of the assembled container 1020. During assembly, the container 1020 can be secured via the adhesive material. A food product can be placed into the container 1020 prior to or after assembly. The closing tab 1024 can then be inserted into the closing channel 1025. When the consumer desires to consume the food product, the actuator 1010 can be self-actuated by the consumer pushing on the actuator 1010 from the back of the container 1020 towards the front of the container. The breakable tabs 1011 can break as the force is applied to the actuator 1010. As the food product is advanced towards the front of the container 1020, the closing tab 1024 becomes disengaged from the closing channel 1025 to create an opening in the container 1020. The closing tab 1024 can move upwards to create a larger opening as more of the food product is advanced through the container 1020 via self-actuation of the actuator 1010. The actuator 1010 can continue to be advanced through the container 1020 by inserting the consumer's finger or other object through the actuator slide slot 1027 at a location behind the actuator 1010 and applying force to the actuator in a direction towards the front of the container 1020. The actuator stabilizing perforations 1023 can help stabilize the actuator 1010 during forward movement. Additionally, the mating engagement of the stabilizing grooves 1021 and stabilizer 1022 can be used to stabilize the perimeter of the container 1020.

Figure 11A:
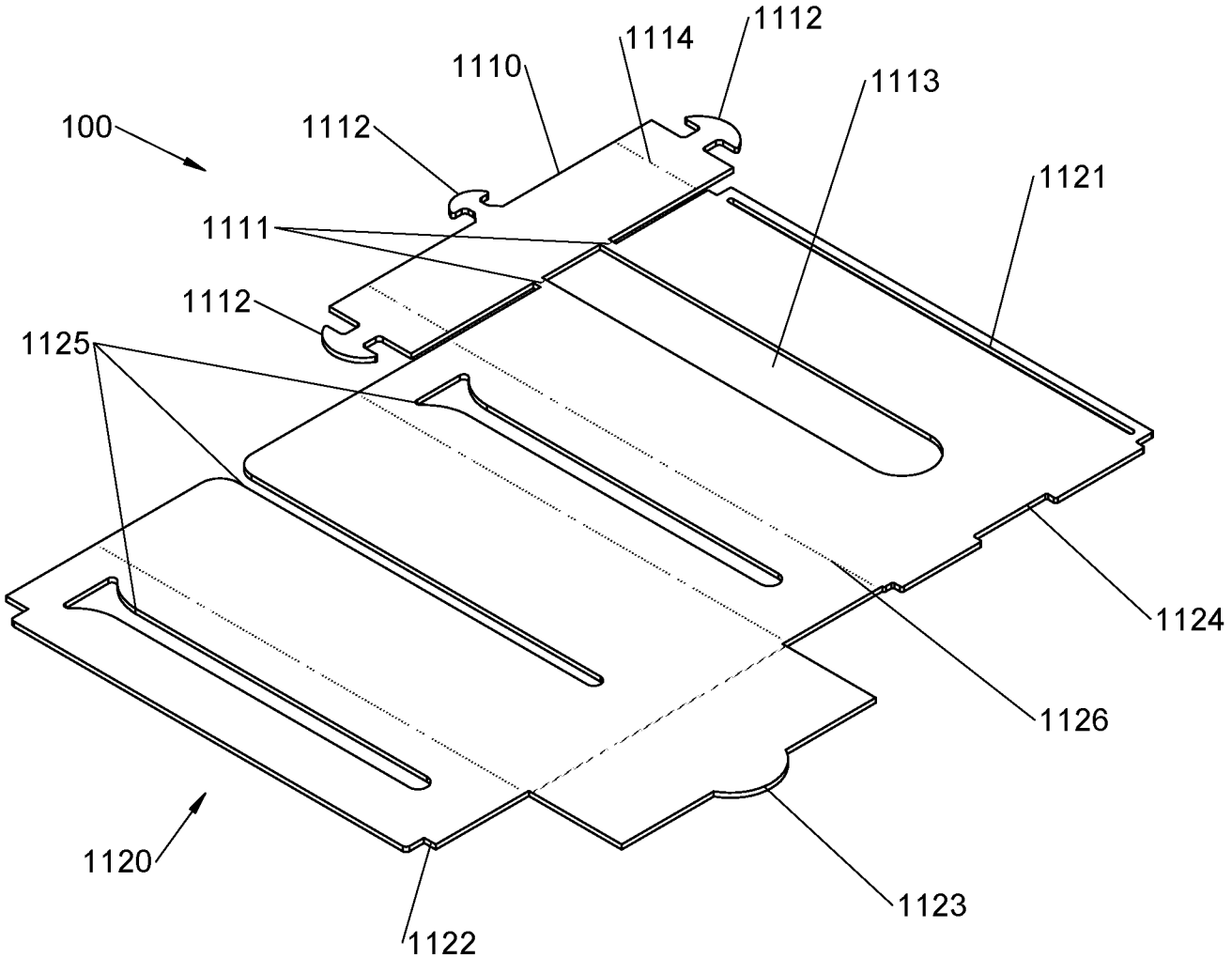
FIG. 11A is a top view of a pre-assembled food container device according to certain embodiments.

FIG. 11A depicts a food container device 100 according to certain other embodiments in a pre-assembled state. The food container device 100 includes an actuator 1110 and a container 1120. The actuator 1110 can be operatively connected to a top and bottom of the container 1120 and forming a back end of the container via breakable tabs 1111. The actuator 1110 can include one or more slides 1112, shown in FIGS. 11A-11C with 3 slides. The actuator 1110 can include folds 1114 that can be perforated or scored for bending of the sides of the actuator 1110.

A bottom of the container 1120 can include stabilizing grooves 1121 running parallel to one or both sides of the bottom adjacent to the edge of the sides. The bottom can also include a closing channel 1124 located at the front of the bottom of the container and an actuator slide slot 1113 located near the middle of the bottom and extending partly or wholly from the back to the front of the bottom.

A top of the container 1120 can include a closing tab 1123. The top and sidewalls of the container 1120 can include slide channels 1125. The container 1120 can include a notched stabilizer 1122 located at the corners of a front end, sidewall and front end, bottom of the container 1120 for mating with the stabilizing grooves 1121. The container 1120 can also include one or more folds 1126 that can be perforated or scored for easier folding of the container 1120 to form sidewalls during assembly.

All or a portion of the edges of the sidewalls on the top of the container 1120 can include an adhesive material running along the majority or entirety of the length of the edge. The adhesive material can be covered with a non-adhesive covering to prevent premature adhesion to an object. The non-adhesive covering can be removed prior to assembly of the container 1120. Sidewalls can be formed during assembly by folding the walls upward or downward via the parallel folds 1126. The adhesive portion of the sidewalls can be moved to overlap the edges of the bottom to create an assembled container 1120.

Figure 11C:
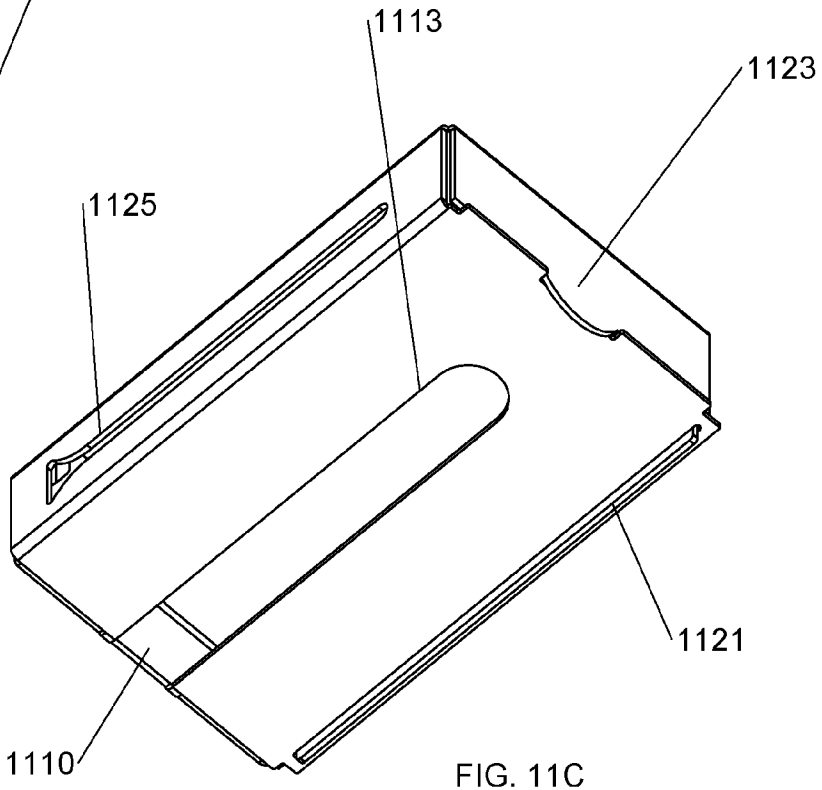
FIG. 11C is a lower perspective view of the food container device of FIG. 11A assembled.
Figure 11B:
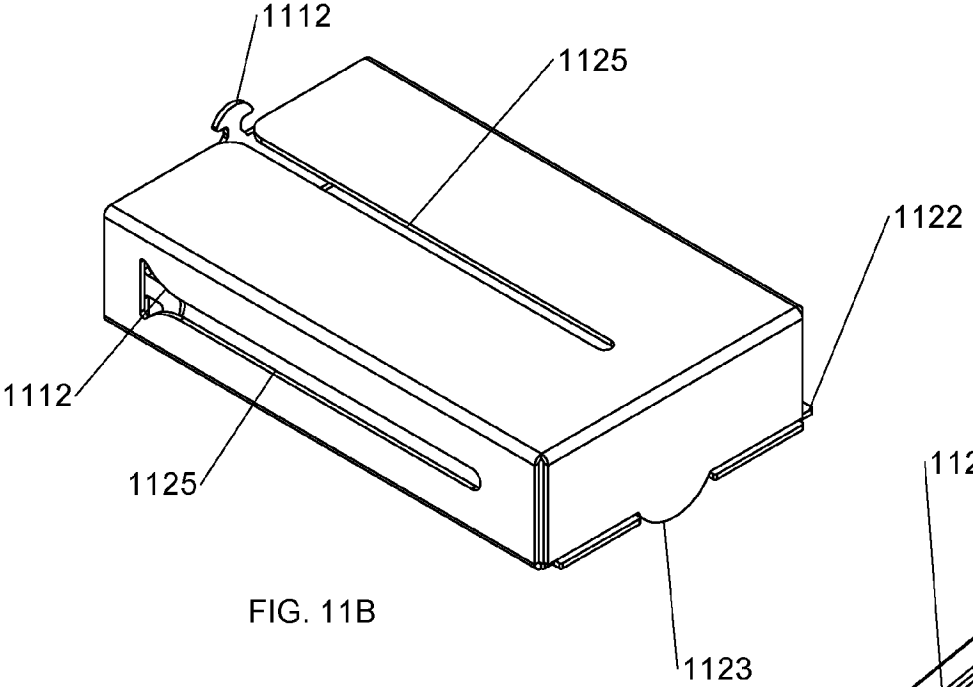
FIG. 11B is an upper perspective view of the food container device of FIG. 11A assembled.

FIG. 11B is a top, front view of the assembled container 1120. FIG. 11C is a bottom perspective view of the assembled container 1120. During assembly: the sides of the actuator 1110 can be folded into the container via folds 1114; sidewalls can be formed by folding the top and sides of the container via folds 1126; the slides 1112 can be positioned within the slide channels 1125; and the container 1120 can be secured via the adhesive material. A food product can be placed into the container 1120 prior to or after assembly. The closing tab 1123 can then be inserted into the closing channel 1124. When the consumer desires to consume the food product, the actuator 1110 can be self-actuated by the consumer pushing on the actuator 1110 from the back of the container 1120 towards the front of the container. The breakable tab 1111 can break as the force is applied to the actuator 1110. As the food product is advanced towards the front of the container 1120, the closing tab 1123 becomes disengaged from the closing channel 1124 to create an opening in the container 1120. The closing tab 1123 can move upwards to create a larger opening as more of the food product is advanced through the container 1120 via self-actuation of the actuator 1110. The actuator 1110 can continue to be advanced through the container 1120 by inserting the consumer's finger or other object through the actuator slide slot 1113 at a location behind the actuator 1110 and applying force to the actuator in a direction towards the front of the container 1120. The slides 1112 moving through the slide channels 1125 can help stabilize the actuator 1110 during forward movement. Additionally, the mating engagement of the stabilizing grooves 1121 and stabilizers 1122 can be used to stabilize the perimeter of the container 1120.

Figure 12A:
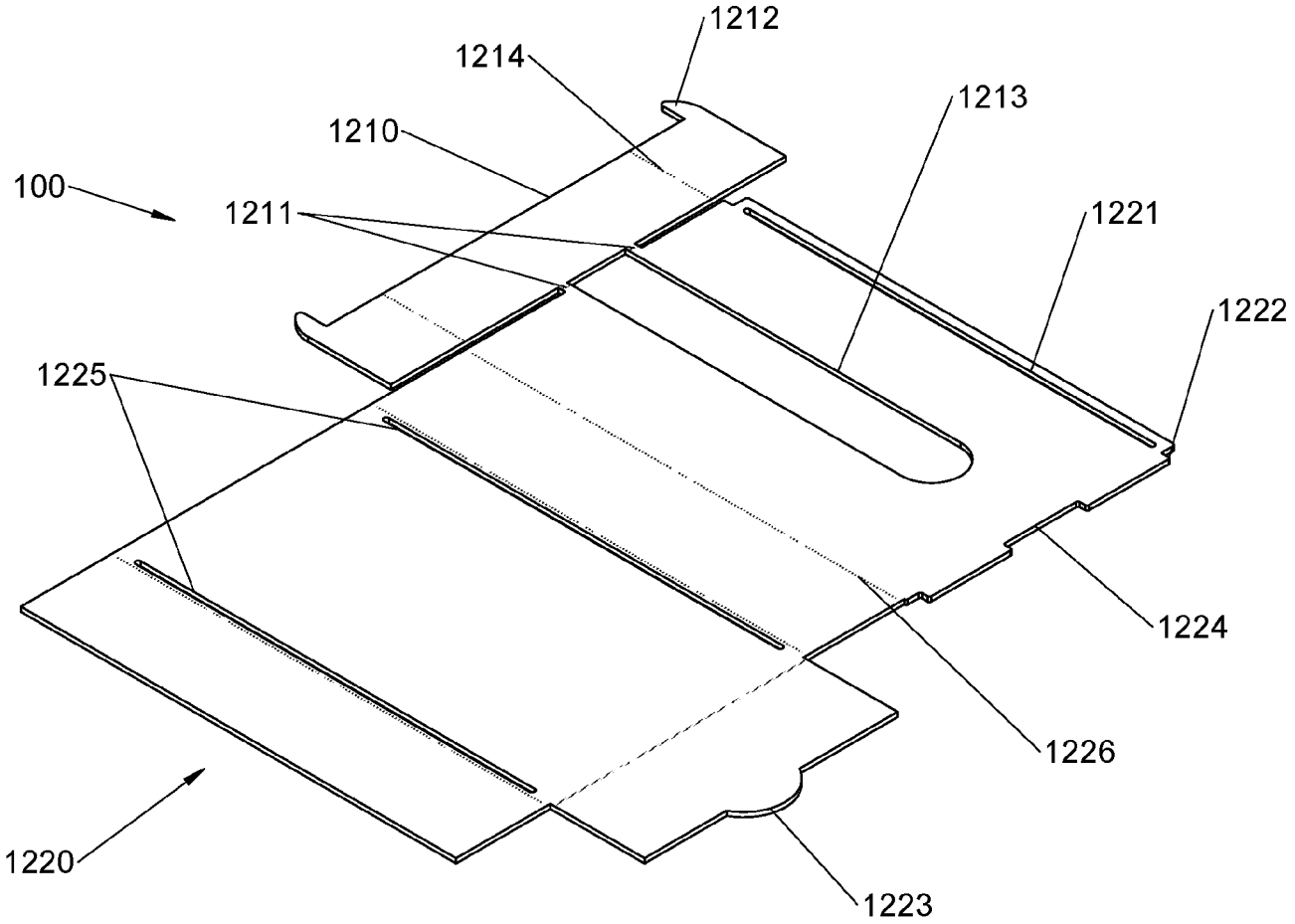
FIG. 12A is a top view of a pre-assembled food container device according to certain embodiments.

FIG. 12A depicts a food container device 100 according to certain other embodiments in a pre-assembled state. The food container device 100 includes an actuator 1210 and a container 1220. The actuator 1210 can be operatively connected to a top and bottom of the container 1220 and forming a back end of the container via breakable tabs 1211. The actuator 1210 can include one or more slides 1212, shown in FIGS. 12A-12C with 2 slides. The actuator 1210 can include folds 1214 that can be perforated or scored for bending of the sides of the actuator 1210.

A bottom of the container 1220 can include stabilizing grooves 1221 running parallel to one or both sides of the bottom adjacent to the edge of the sides. The bottom can also include a closing channel 1224 located at the front of the bottom of the container and an actuator slide slot 1213 located near the middle of the bottom and extending partly or wholly from the back to the front of the bottom.

A top of the container 1220 can include a closing tab 1223. The top of the container 1220 can include slide channels 1225. The container 1220 can include a notched stabilizer 1222 located at the corners of a front end, sidewall and front end, bottom of the container 1220 for mating with the stabilizing grooves 1221. The container 1220 can also include one or more folds 1226 that can be perforated or scored for easier folding of the container 1120 to form sidewalls during assembly.

All or a portion of the edges of the sidewalls on the top of the container 1220 can include an adhesive material running along the majority or entirety of the length of the edge. The adhesive material can be covered with a non-adhesive covering to prevent premature adhesion to an object. The non-adhesive covering can be removed prior to assembly of the container 1220. Sidewalls can be formed during assembly by folding the walls upward or downward via the parallel folds 1226. The adhesive portion of the sidewalls can be moved to overlap the edges of the bottom to create an assembled container 1220.

Figure 12C:
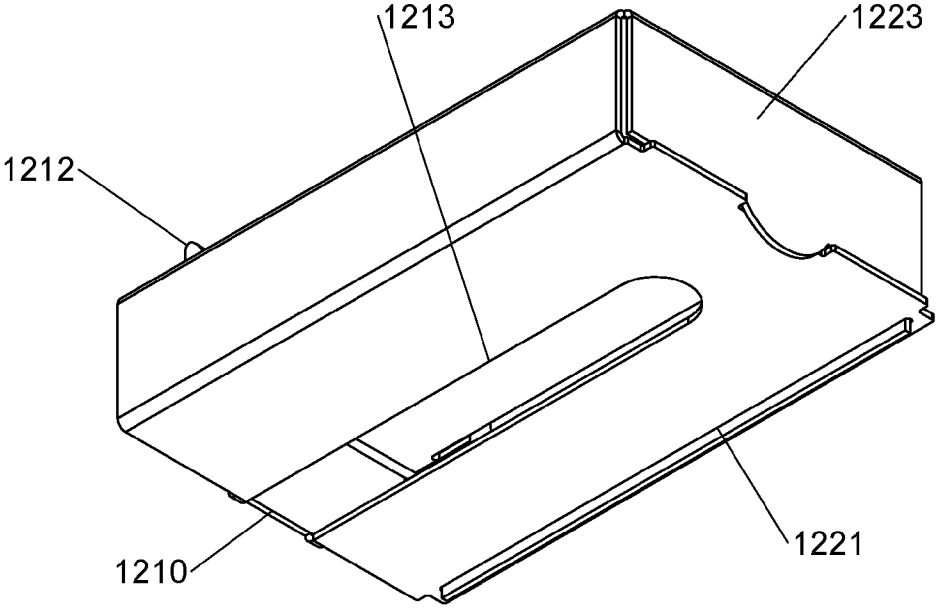
FIG. 12C is a lower perspective view of the food container device of FIG. 12A assembled.
Figure 12B:
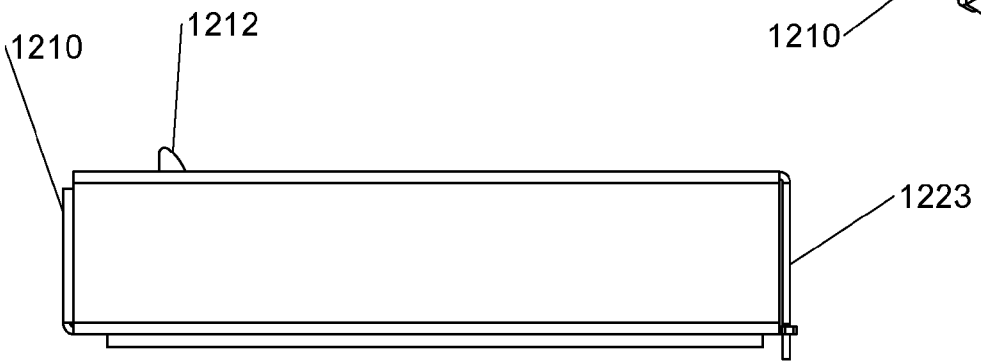
FIG. 12B is a side view of the food container device of FIG. 12A assembled.

FIG. 12B is a side view of the assembled container 1220. FIG. 12C is a bottom perspective view of the assembled container 1220. During assembly: the sides of the actuator 1210 can be folded into the container via folds 1214;

sidewalls can be formed by folding the top and sides of the container via folds 1226; the slides 1212 can be positioned within the slide channels 1225; and the container 1220 can be secured via the adhesive material. A food product can be placed into the container 1220 prior to or after assembly. The closing tab 1223 can then be inserted into the closing channel 1224. When the consumer desires to consume the food product, the actuator 1210 can be self-actuated by the consumer pushing on the actuator 1210 from the back of the container 1220 towards the front of the container. The breakable tab 1211 can break as the force is applied to the actuator 1210. As the food product is advanced towards the front of the container 1220, the closing tab 1223 becomes disengaged from the closing channel 1224 to create an opening in the container 1220. The closing tab 1223 can move upwards to create a larger opening as more of the food product is advanced through the container 1220 via self-actuation of the actuator 1210. The actuator 1210 can continue to be advanced through the container 1220 by inserting the consumer's finger or other object through the actuator slide slot 1213 at a location behind the actuator 1210 and applying force to the actuator in a direction towards the front of the container 1220. The slides 1212 moving through the slide channels 1225 can help stabilize the actuator 1210 during forward movement. Additionally, the mating engagement of the stabilizing grooves 1221 and stabilizers 1222 can be used to stabilize the perimeter of the container 1220.

Figure 13A:
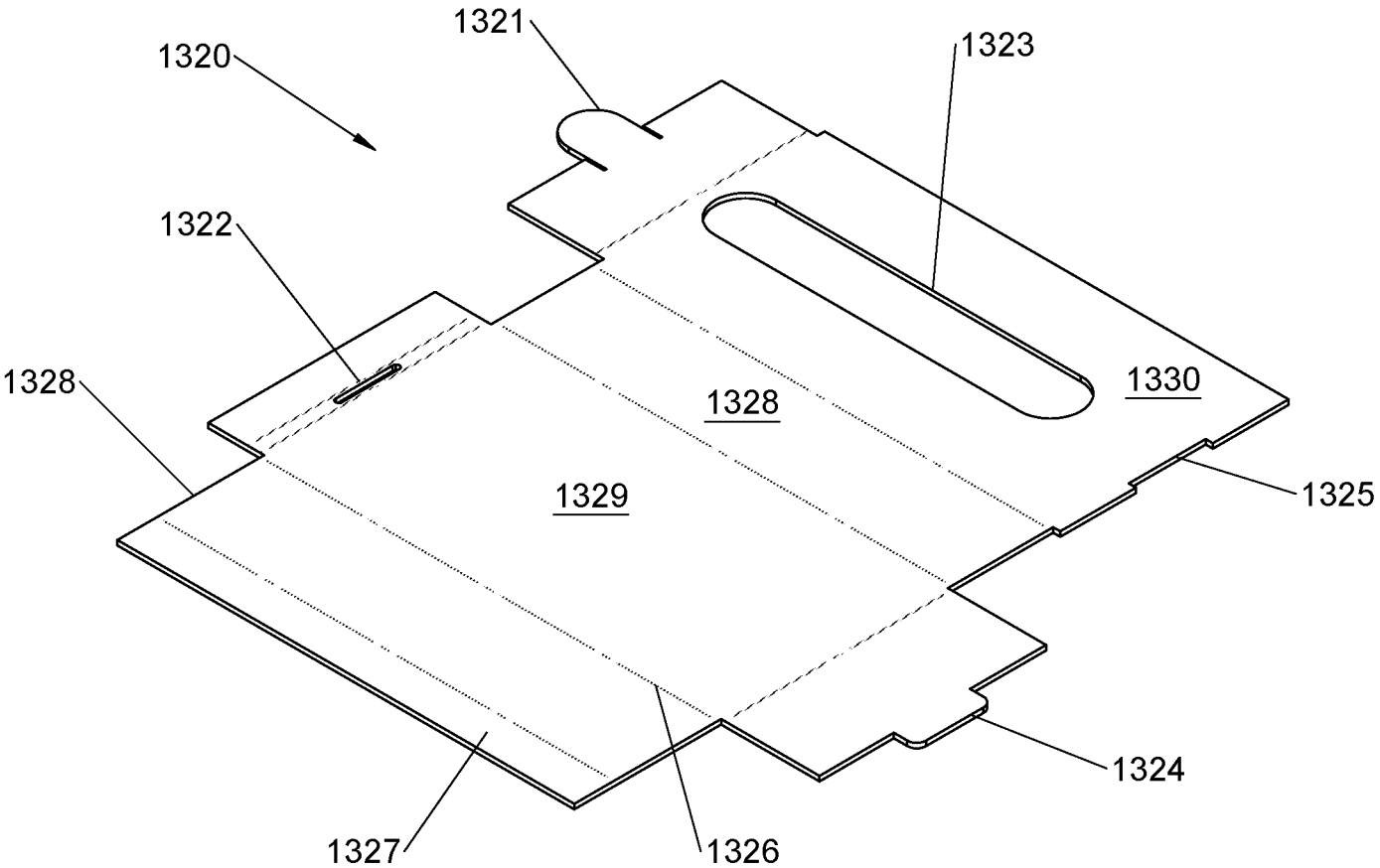
FIG. 13A is a top view of a pre-assembled food container device according to certain embodiments.

FIGS. 13A-13D depict a food container device 100 according to certain other embodiments. FIG. 13A shows the food container device 100 in a pre-assembled state. The food container device 100 includes a container 1320. The container 1320 can include a first closing tab 1321, a first closing slot 1322, a second closing tab 1324, and a second closing channel 1325. The container 1320 can also include a slide slot 1323. The container 1320 can also include one or more folds 1326 that can be perforated or scored for ease in folding portions of the container during assembly. The folds 1326 can be used to form sidewalls 1328, a top 1329 of the container, and a bottom 1330 of the container.

All or a portion of a sealing wall 1327 can include an adhesive material running along the majority or entirety of the length of the sealing wall 1327. The adhesive material can be covered with a non-adhesive covering to prevent premature adhesion to an object. The non-adhesive covering can be removed prior to assembly of the container 1320. The sidewalls 1328, top 1329, and bottom 1330 of the container 1320 can be formed during assembly by folding the walls upward or downward via the parallel folds 1326. The adhesive portion of the sidewalls can be moved to overlap the edges of the bottom 1330 to create an assembled container 1320.

Figure 13C:
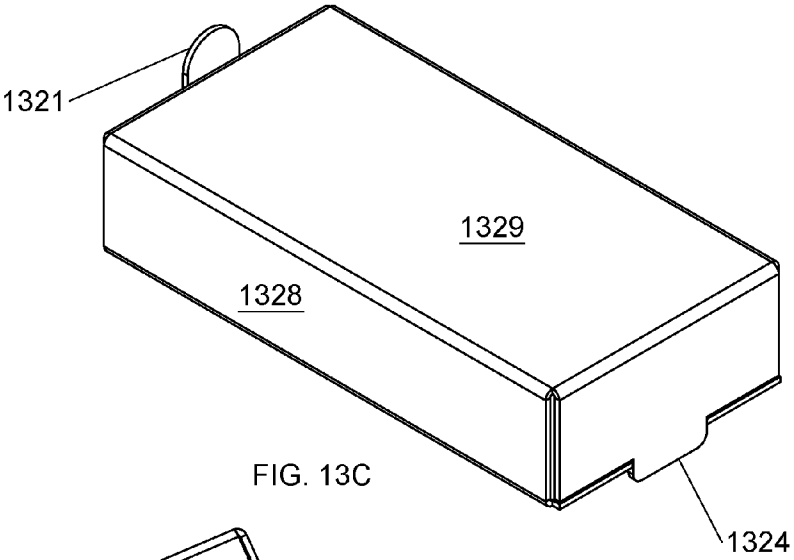
FIG. 13C is an upper, front perspective view of the food container device of FIG. 13A assembled.
Figure 13D:
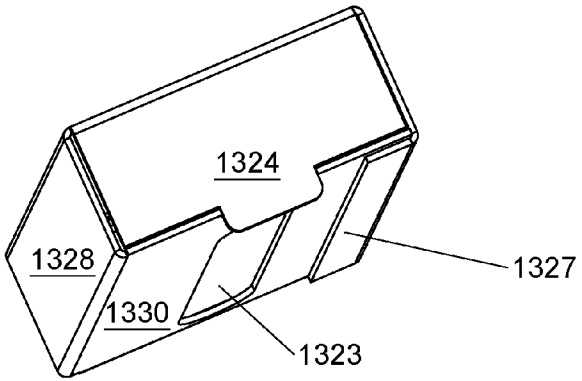
FIG. 13D is a lower, front perspective view of the food container device of FIG. 13A assembled.
Figure 13B:
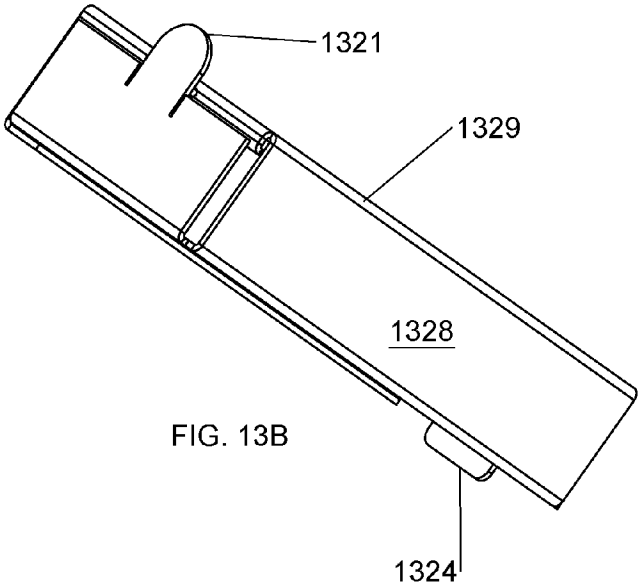
FIG. 13B is a back, side perspective view of the food container device of FIG. 13A assembled.

FIG. 13B is a side, back view of the assembled container 1320. FIG. 13C is a front, top view of the assembled container 1320; while FIG. 13D is a bottom, front view of the assembled container 1320. During assembly, the container 1320 can be secured via the adhesive material. A food product can be placed into the container 1320 prior to or after assembly. The first closing tab 1321 can then be inserted into the first closing slot 1322. The second closing tab 1324 can be inserted into the second closing channel 1325. When the consumer desires to consume the food product, the food product can be self-actuated by the consumer inserting the consumer's finger or other object through the slide slot 1323 at a location behind the food product and applying force to the food product in a direction towards the front of the container 1320. As the food product is advanced towards the front of the container 1320, the second closing tab 1324 becomes disengaged from the second closing channel 1325 to create an opening in the container 1320. The first closing tab 1321 can move upwards to create a larger opening as more of the food product is advanced through the container 1320 via self-actuation of the food product. According to this embodiment, the actuator is a consumer's finger or other insertable object.

The food container device 100 according to the various embodiments can include one or more features, such as stack slots or standoffs, that allow nesting or stacking of multiple containers in order to reduce the amount of storage space needed at a restaurant or in a warehouse or during transportation. By way of example, the container can be collapsible, include tapered sidewalls for nesting, or fold out into a flat, pre-assembled position. The container can be designed such that no assembly is required in order to place the food product inside the container. The container can also be designed such that some assembly is required in order to place the food product inside the container. Assembly of any pre-assembled food container device 100 can be performed at a manufacturing facility, storage facility, or at a business providing the device (e.g., prior to or at the time a food product is placed in the container).

The food container device 100 according to the various embodiments includes an actuator that is used to move the food product through the container by a consumer via self-actuation. The container and the actuator can include a system for movement of the food product through the container is a direction towards an opening in the container. In this manner, the consumer can utilize the actuator to move the food product through the container towards the opening of the container for consumption of the food product. The container can also include one or more guides for movement of the food product within the container.

The food container device 100 according to the various embodiments can be made from a variety of materials. Examples of materials include, but are not limited to, cardboard, paper products, celluloses, reinforced celluloses, modified celluloses, plastics, etc. The materials can include recycled materials. The food container device 100 can also include insulating materials or layers of an insulating material to help retain heat of the food product. The food container device can be made using a variety of manufacturing techniques, including but not limited to, pulp molding, perforated materials, stamping, plastic injection molding, die-cutting, laser cutting, water jet cutting, and 3D printing.

The food container device 100 according to the various embodiments can have a variety of dimensions. According to certain embodiments, the dimensions are selected such that a food product can be housed within the container without damaging the food product and impeding movement of the food product through the container. The folds can also be positioned on the container and/or actuator to provide the desired dimensions. The length, height, and width of the container can range from about 3 inches (in) (7.6 centimeters (cm)) to about 9 in (22.9 cm). The thickness of the various parts making up the food container device 100 can range from about 0.03 in (0.08 cm) to about 1 in (2.5 cm). The thicknesses of the various parts making up the food container device 100 can be the same or different.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is, therefore, evident that the particular illustrative embodiments disclosed above may be altered or modified and all such variations are considered within the scope and spirit of the present invention.

As used herein, the words "comprise," "have," "include," and all grammatical variations thereof are each intended to have an open, non-limiting meaning that does not exclude additional elements or steps. While compositions, systems, and methods are described in terms of "comprising," "containing," or "including" various components or steps, the compositions, systems, and methods also can "consist essentially of" or "consist of" the various components and steps. It should also be understood that, as used herein, "first," "second," and "third," are assigned arbitrarily and are merely intended to differentiate between two or more tabs, etc., as the case may be, and does not indicate any sequence. Furthermore, it is to be understood that the mere use of the word "first" does not require that there be any "second," and the mere use of the word "second" does not require that there be any "third," etc.

Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent(s) or other documents that may be incorporated herein by reference, the definitions that are consistent with this specification should be adopted.

What is claimed is:

1. A non-liquid food container device comprising:

a container for housing the non-liquid food product comprising a top end, a bottom end, and sidewalls, wherein the bottom end comprises one or more flanges created by one or more breakable tabs or voids, and wherein the flanges are arranged circumferentially around the bottom end of the container; and an actuator, wherein the actuator is self-actuated to move the non-liquid food product through the container, wherein the actuator comprises a top end with a rim, a bottom end, and sidewalls, wherein one or more slots are arranged around the sidewalls, and wherein the slots create voids within the sidewalls of the actuator, wherein the actuator is self-actuated by insertion of the top end of the actuator into the bottom end of the container and forced in an upward direction towards the top end of the container, and wherein the flanges mate with and fit within the slots of the actuator.

2. The device according to claim 1, wherein the container is cylindrical, conical, pyramidal, square, rectangular, or half-circle in shape.

3. The device according to claim 1, wherein the actuator is operatively connected to the container.

4. The device according to claim 1, wherein the actuator, container, or both the actuator and container are in a pre-assembled state, and wherein a portion of the actuator, container, or both the actuator and container comprises an adhesive material for assembling the device.

5. The device according to claim 1, wherein the container comprises one or more guides for actuation of the actuator and food product through the container.

6. The device according to claim 1, wherein the food container device is made from a material selected from the group consisting of cardboard, paper products, celluloses, reinforced celluloses, modified celluloses, plastics, and combinations thereof.

7. The device according to claim 6, further comprising an insulating material or layers of an insulating material for retention of heat from the food product.

8. A non-liquid food container device comprising:

a container for housing the non-liquid food product, wherein the container comprises a top end, a bottom end, and sidewalls, wherein one or more slots are arranged around the sidewalls of the container, and wherein the slots create voids within the sidewalls of the container; and an actuator, wherein the actuator is self-actuated to move the non-liquid food product through the container, wherein the actuator comprises a top end with a rim, a bottom end, sidewalls, and one or more flanges created by one or more breakable tabs or voids, and wherein the flanges are arranged circumferentially around the actuator, wherein the actuator is self-actuated by insertion of the top end of the actuator into the bottom end of the container and forced in an upward direction towards the top end of the container, and wherein the flanges mate with and fit within the slots of the container.

9. The device according to claim 8, wherein the actuator, container, or both the actuator and container are in a pre-assembled state, and wherein a portion of the actuator, container, or both the actuator and container comprises an adhesive material for assembling the device.

10. The device according to claim 8, wherein the food container device is made from a material selected from the group consisting of cardboard, paper products, celluloses, reinforced celluloses, modified celluloses, plastics, and combinations thereof.

11. The device according to claim 10, further comprising an insulating material or layers of an insulating material for retention of heat from the food product.

12. A non-liquid food container device comprising:

a container for housing the non-liquid food product, wherein the container comprises two slide channels and a closing channel; and an actuator, wherein the actuator is self-actuated to move the non-liquid food product through the container, wherein and the actuator comprises a slide tab and a closing tab, wherein the actuator is self-actuated by movement of the slide tab through the slide channels, and wherein during self-actuation, the closing tab becomes disengaged from the closing channel to create an opening in the container.

13. The device according to claim 12, wherein the actuator, container, or both the actuator and container are in a pre-assembled state, and wherein a portion of the actuator, container, or both the actuator and container comprises an adhesive material for assembling the device.

14. The device according to claim 12, wherein the food container device is made from a material selected from the group consisting of cardboard, paper products, celluloses, reinforced celluloses, modified celluloses, plastics, and combinations thereof.

15. The device according to claim 14, further comprising an insulating material or layers of an insulating material for retention of heat from the food product.

* * * * *